US008104142B2

(12) United States Patent
Lowry et al.

(10) Patent No.: US 8,104,142 B2
(45) Date of Patent: Jan. 31, 2012

(54) DROP-IN DAMPED HINGE MODULE

(75) Inventors: David Lowry, Wayne, PA (US); Eugene Novin, Blue Bell, PA (US); Mark Cooper, Boothwyn, PA (US)

(73) Assignee: Southco, Inc., Concordville, PA (US)

( * ) Notice: Subject to any disclaimer, the term of this patent is extended or adjusted under 35 U.S.C. 154(b) by 482 days.

(21) Appl. No.: 12/281,221

(22) PCT Filed: Mar. 2, 2006

(86) PCT No.: PCT/US2006/007936

§ 371 (c)(1),
(2), (4) Date: Aug. 29, 2008

(87) PCT Pub. No.: WO2007/106077

PCT Pub. Date: Sep. 20, 2007

(65) Prior Publication Data

US 2009/0133219 A1 May 28, 2009

(51) Int. Cl.
*E05F 1/08* (2006.01)

(52) U.S. Cl. ..... 16/307; 16/299

(58) Field of Classification Search ..... 16/307, 16/308, 304, 374, 375, 50, 54, 300, 298, 16/299

See application file for complete search history.

(56) References Cited

U.S. PATENT DOCUMENTS

| | | | | |
|---|---|---|---|---|
| 434,877 | A | 8/1890 | Morrow | |
| 571,133 | A | 11/1898 | Hoffman | |
| 2,520,616 | A * | 8/1950 | Wasson et al. | 16/300 |
| 2,710,782 | A | 6/1955 | Chaft | |
| 3,401,422 | A | 9/1968 | Ventura | |
| 3,898,708 | A * | 8/1975 | Gwozdz | 16/301 |
| 3,975,794 | A | 8/1976 | Kaiser et al. | |
| 4,489,974 | A | 12/1984 | Warhol | |
| 4,625,657 | A | 12/1986 | Little et al. | |
| 4,630,332 | A | 12/1986 | Bisbing | |
| 4,630,333 | A | 12/1986 | Vickers | |
| 4,764,075 | A | 8/1988 | Cox et al. | |
| 4,836,482 | A | 6/1989 | Sokol | |
| 5,111,503 | A | 5/1992 | Takagi | |
| 5,138,743 | A | 8/1992 | Hoffman | |
| 5,142,738 | A | 9/1992 | Ojima | |
| 5,199,777 | A | 4/1993 | Taima et al. | |
| 5,257,310 | A | 10/1993 | Takagi et al. | |
| 5,257,767 | A | 11/1993 | McConnell | |
| 5,276,945 | A | 1/1994 | Matsumura | |
| 5,406,678 | A | 4/1995 | Kaden et al. | |
| 5,412,842 | A | 5/1995 | Riblett | |
| 5,487,525 | A | 1/1996 | Drabczyk et al. | |

(Continued)

FOREIGN PATENT DOCUMENTS

WO W02007016613 A2 2/2007

(Continued)

*Primary Examiner* — Chuck Y. Mah
(74) *Attorney, Agent, or Firm* — Paul & Paul

(57) ABSTRACT

A damped hinge module is disclosed and includes a first member, a second member and a torsion spring. The second member is rotationally movable relative to the first member between a first position and a second position. The second member being received at least in part within the first member. The torsion spring is located internally with respect to the first member and biases the second member toward the first position relative to the first member. The spring has a preload with the second member in the first position relative to the first member.

16 Claims, 21 Drawing Sheets

U.S. PATENT DOCUMENTS 5,491,874 A 2/1996 Lowry et al.
5,584,100 A * 12/1996 Doyle et al. ..... 16/301
5,600,868 A 2/1997 Tourville et al.
5,628,089 A 5/1997 Wilcox et al.
5,629,979 A 5/1997 Domoleczny
5,682,644 A 11/1997 Bohacik et al.
5,697,124 A 12/1997 Jung
5,697,125 A 12/1997 Gannon
5,697,303 A 12/1997 Allan
5,715,576 A 2/1998 Liu
5,724,683 A 3/1998 Sorimachi et al.
5,752,293 A 5/1998 Lowry et al.
5,765,263 A 6/1998 Bolinas et al.
5,848,152 A 12/1998 Slipy et al.
5,867,872 A 2/1999 Katoh
5,915,441 A 6/1999 Schlack
5,923,751 A 7/1999 Ohtsuka et al.
5,937,062 A 8/1999 Sun et al.
6,122,801 A 9/2000 Reichert et al.
6,125,030 A 9/2000 Mola et al.
6,141,831 A 11/2000 Novin et al.
6,178,598 B1 1/2001 Creely, III et al.
6,182,330 B1 2/2001 Novin et al.
6,186,460 B1 2/2001 Lin
D439,130 S 3/2001 Ford et al.
6,249,426 B1 6/2001 O'Neal et al.
6,270,047 B1 8/2001 Hudson
6,301,748 B1 10/2001 Su-Man
6,305,050 B1 10/2001 Imai
6,336,252 B1 1/2002 Bando
6,421,878 B1 7/2002 Kaneko et al.
6,459,887 B2 10/2002 Okuda
6,467,129 B1 10/2002 Bae
6,601,269 B2 8/2003 Oshima et al.
6,634,061 B1 10/2003 Maynard
6,665,906 B2 12/2003 Li
6,684,456 B2 2/2004 Lee
6,757,940 B2 7/2004 Lu et al.
6,789,292 B2 9/2004 Oshima et al.
6,817,061 B2 11/2004 Wu et al.
6,862,779 B1 3/2005 Lu et al.
6,871,384 B2 3/2005 Novin et al.
6,928,700 B2 8/2005 Huong
6,941,617 B2 9/2005 Pinto
6,983,514 B2 1/2006 Lu et al.
6,985,580 B2 1/2006 Lu et al.
7,065,834 B2 6/2006 Lowry
7,127,911 B2 10/2006 Nam et al.
7,210,199 B2 * 5/2007 Clark ..... 16/299
7,320,152 B2 1/2008 Lowry et al.
2002/0042970 A1 4/2002 Liao
2002/0124351 A1 9/2002 Lowry et al.
2002/0167789 A1 11/2002 Novin et al.
2002/0198016 A1 12/2002 Gupte
2003/0046793 A1 3/2003 Novin et al.
2004/0123782 A1 7/2004 Korber et al.
2004/0261220 A1 12/2004 Lowry
2005/0034269 A1 2/2005 Jinbo
2005/0056755 A1 3/2005 Kimura
2006/0048337 A1 3/2006 Lowry et al.
2006/0048338 A1 3/2006 Lowry et al.
2008/0189908 A1 8/2008 Lowry et al.
2008/0196201 A1 8/2008 Anderson

FOREIGN PATENT DOCUMENTS

WO W02007106077 A2 9/2007

* cited by examiner

DROP-IN DAMPED HINGE MODULE

BACKGROUND OF THE INVENTION

This invention generally relates to hinge modules and, more particularly, to a damped hinge module that can be preassembled for drop-in installation within a device.

Typically, damped hinges must be assembled during assembly of devices or other objects within which the hinges are placed. That is, the hinges themselves must be assembled in addition to assembling the devices, thereby adding potentially costly steps and time to the assembly of the devices. Additionally, if the hinges are produced by an entity other than the manufacturer of the device, the hinges are typically required to be shipped unassembled to the ultimate manufacturer of the device and assembled by the ultimate manufacturer during assembly of the devices. Such a situation can lead to problems with quality control with respect to the hinges due to the hinges being assembled by an entity other than the hinge manufacturer.

Therefore, it would be desirable to have a damped hinge module that can be preassembled to allow the hinge module to be relatively easily "dropped-in" to a device by the manufacturer of the device. In this way, time and costs of assembly of the devices can be reduced and quality of the assembled hinge modules can be better controlled by the hinge manufacturer.

SUMMARY OF THE INVENTION

The present invention is directed to a damped hinge module that includes a first member, a second member and a torsion spring. The second member is rotationally movable relative to the first member between a first position and a second position. The second member is received at least in part within the first member. The torsion spring is located internally with respect to the first member and biases the second member toward the first position relative to the first member. The spring has a preload with the second member in the first position relative to the first member. Grease is provided between the first member and the second member to damp the movement of the second member relative to the first member.

Accordingly, it is an object of the present invention to provide a "drop-in" hinge module.

It is a further object of the present invention to provide a damped hinge module.

It is yet another object of the present invention to provide a hinge module where one member is spring biased toward a first position with respect to the other member and where the spring is preloaded when the one member is in the first position with respect to the other member.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
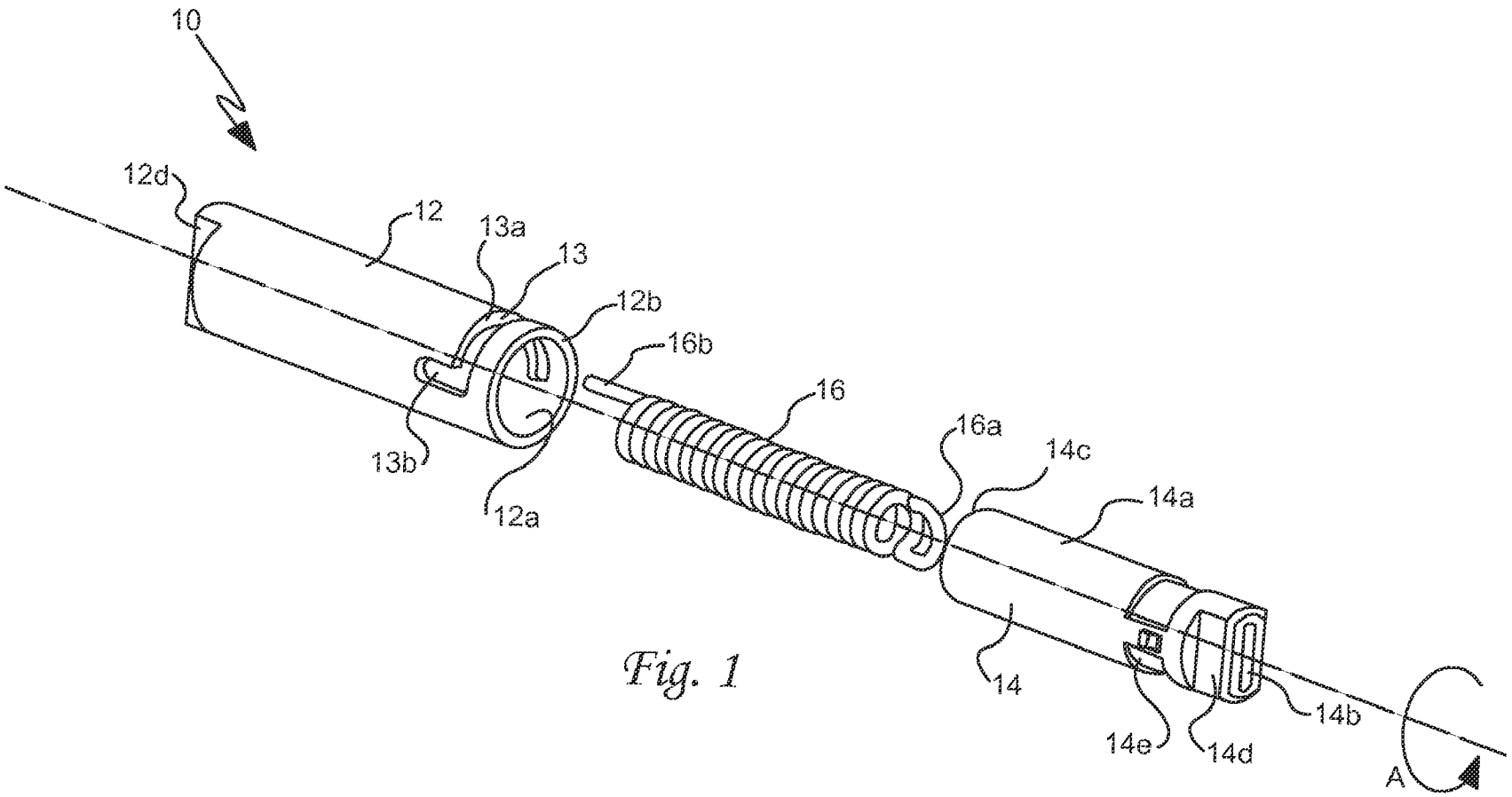
FIG. 1 is an exploded perspective view of a hinge module in accordance with a first preferred embodiment of the present invention.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Figure 2:
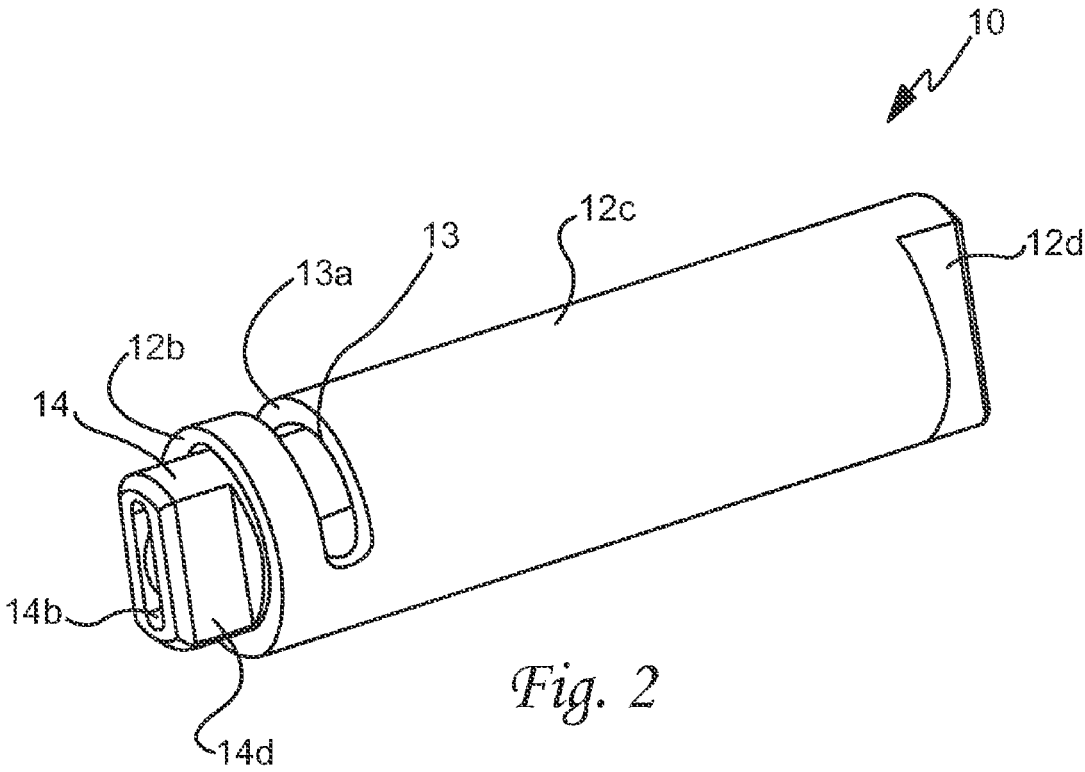
FIG. 2 is a perspective view of the hinge module of FIG. 1 in an assembled state.
Figure 3:
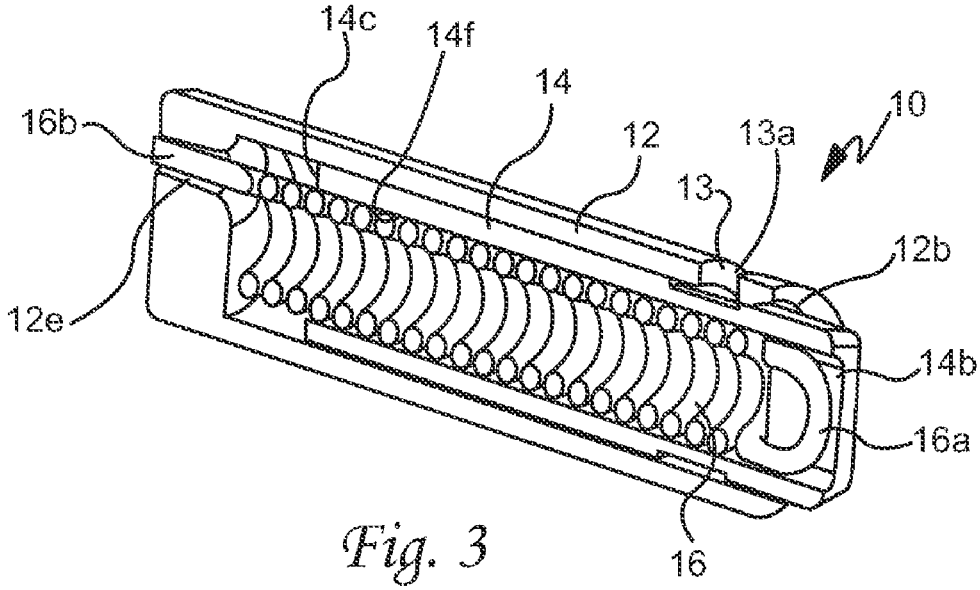
FIG. 3 is a cross-sectional perspective view of the hinge module of FIG. 2.

Referring to the drawing in detail, wherein like numerals indicate like elements throughout, there is shown in FIGS. 1-3 a first preferred embodiment of a drop-in, damped hinge module, indicated generally at 10, in accordance with the present invention. Referring to FIGS. 1 and 3, the hinge module 10 preferably includes generally tubular outer and inner housings 12, 14. The inner housing 14 is preferably sized to fit snugly within the outer housing 12. The outer housing 12 has an open end 12*b* that allows access to an interior surface 12*a* of the outer housing 12. Similarly, the inner housing 14 has an open end 14*c* to allow access to an interior 14*f* of the inner housing 14. Preferably, a slot 14*b* is disposed within an end opposite the open end 14*c* of the inner housing 14. The inner housing 14 further includes an exterior surface 14*a*.

Referring, to FIGS. 1-3, to assemble the hinge module 10, a torsion spring 16, appropriately sized to fit into the open end 14*c* of the inner housing 14, is preferably disposed within the inner housing 14. A generally hook-shaped first end 16*a* of the torsion spring 16 fits within the slot 14*b* of the inner housing 14 to rotationally couple the inner housing 14 with the first end 16*a* of the torsion spring 16. The outer housing 12 is then placed over the inner housing 14 and the torsion spring 16 so that a second end 16*b*, opposite the first end 16*a* of the torsion spring 16, engages within a hole 12*e* in the outer housing 12 to rotationally couple the outer housing 12 with the second end 16*b* of the torsion spring 16. The outer housing 12 preferably snaps onto the inner housing 14 to hold the hinge module 10 together as a single integrated unit. Preferably, this is accomplished by providing a slot 13 just inward of the open end 12*b* on the outer housing 12 that receives a raised rib 14*e* or other similar structure at one end of the inner housing 14 in a snap-fit fashion to inhibit linear relative motion but permit rotational relative motion. Although this is preferred, it is within the spirit and scope of the present invention that the outer and inner housings 12, 14 be joined in another Suitable manner.

Referring, specifically to FIG. 1, the slot 13 preferably has a first portion 13*a* that extends generally circumferentially around at least a portion of the outer housing 12 and a second portion 13*b* that extends generally axially from an end of the first portion 13*a* along the outer housing 12 for a distance away from the open end 12*b*. This configuration of the slot 13 allows the inner housing 14 to rotate a certain amount with respect to the outer housing 12 when the raised rib 14*e* rides within the first portion 13*a* of the slot 13. The slot 13 further allows limited axial motion of the inner housing 14 with respect to the outer housing 12 when the raised rib 14*e* is aligned with the second portion 13*b* of the slot 13. When so aligned, the inner housing 14 can be pushed slightly further into the outer housing 12, thereby slightly compressing the torsion spring 16 and shortening an overall length of the hinge module 10 while force is applied to either end of the hinge module 10.

Additionally, damping grease (not shown) is preferably inserted between the exterior surface 14*a* of the inner housing 14 and the interior surface 12*a* of the outer housing 12. The outer and inner housings 12, 14 each have engagement surfaces 12*d*, 14*d* to allow the hinge module 10 to engage a lid (not shown) and a base (not shown) of an object (not shown) in which the hinge module 10 is to be used.

The hinge module 10 is preferably preassembled to form a stand-alone unit, as shown in FIG. 2, to avoid the necessity of assembling the hinge module 10 during assembly of the object in which the hinge module 10 is to be installed. In this way, the hinge module 10 can simply be "dropped into" an object, thereby facilitating assembly of the object. That is, force can be applied to either end of the hinge module 10 to shorten the hinge module 10 slightly, as described above, thereby providing enough clearance to allow the hinge module 10 to be inserted into a mounting location (not shown) of the object. Once "dropped in", the torsion spring 16 expands axially to its uncompressed length to restore the hinge module 10 to its normal length and force the engagement surfaces 12*d*, 14*d* of the outer and inner housings 12, 14, respectively, into engagement with corresponding engagement surfaces of the lid and the base. In this way, the hinge module 10 can be relatively easily placed between the base and the lid and retained within the object during assembly of the object. The engagement surfaces 12*d* of the outer housing 12 engage and rotationally couple the outer housing 12 with one of the lid and the base. The engagement surfaces 14*d* of the inner housing 14 engage and rotationally couple the inner housing 14 with the other of the lid and the base of the object. Although this method of installation into and rotational coupling with the object is preferred, it is within the spirit and scope of the present invention that the hinge module 10 be installed in a different manner, such as sliding the hinge module 10 into corresponding slots within the object, for instance, or that a different method for rotationally coupling the object to the hinge module 10 be used, so long as the alternate rotational coupling method allows the hinge module 10 to perform in the manner described herein.

Preferably, the outer and inner housings 12, 14 are formed of a polymeric material and the torsion spring 16 is made from a metallic material. Specifically, it is preferred that the outer and inner housings 12, 14 be injection molded out of a plastic material, such as a PC/ABS blend, for instance, although many other resins could be used instead. Although this is preferred, it is within the spirit and scope of the present invention that the outer and inner housings 12, 14 and the torsion spring 16 be formed from other suitable materials using other manufacturing processes, provided the hinge module 10 is still capable of functioning as described herein.

Figure 4:
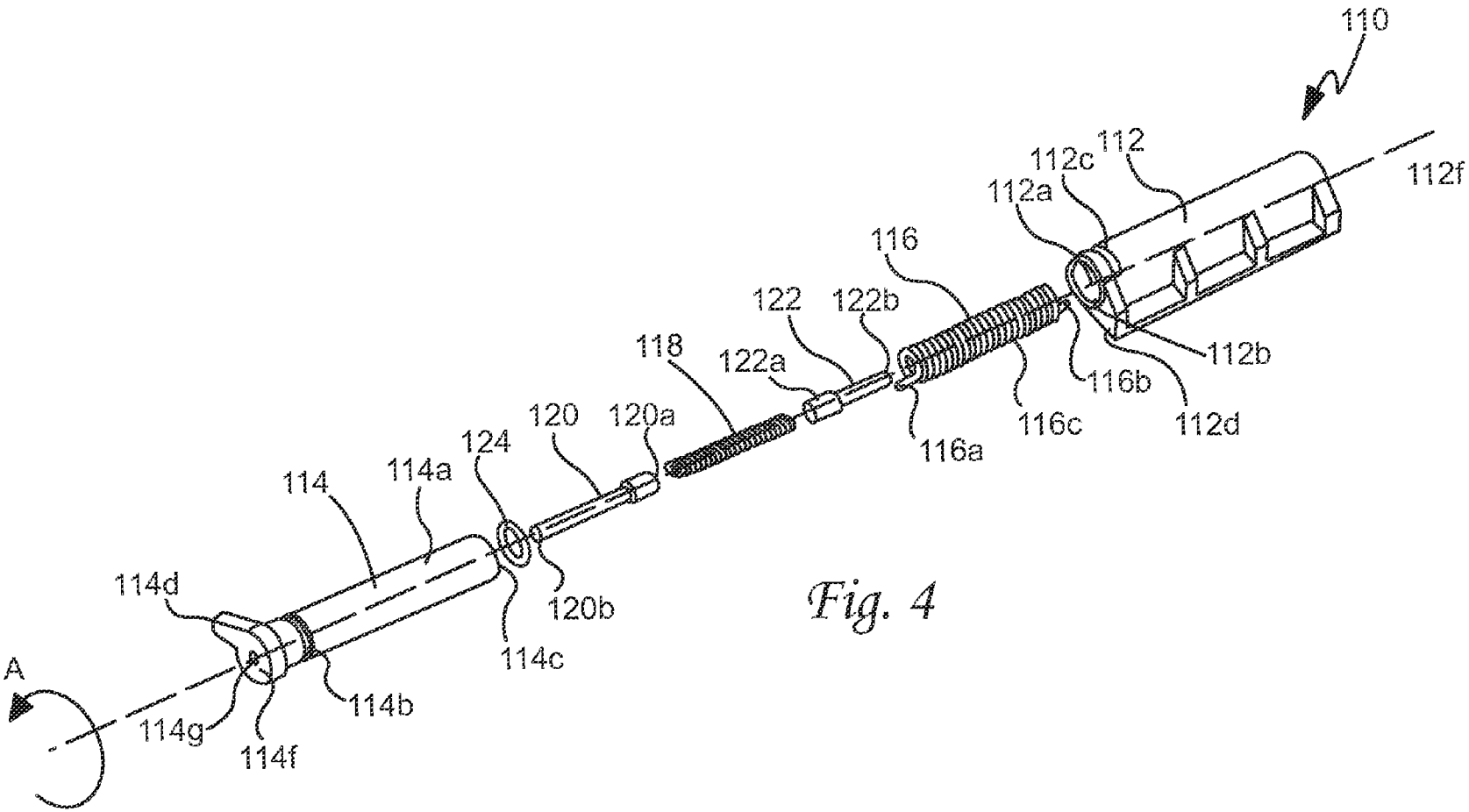
FIG. 4 is an exploded perspective view of a hinge module in accordance with a second preferred embodiment of the present invention.
Figure 5:
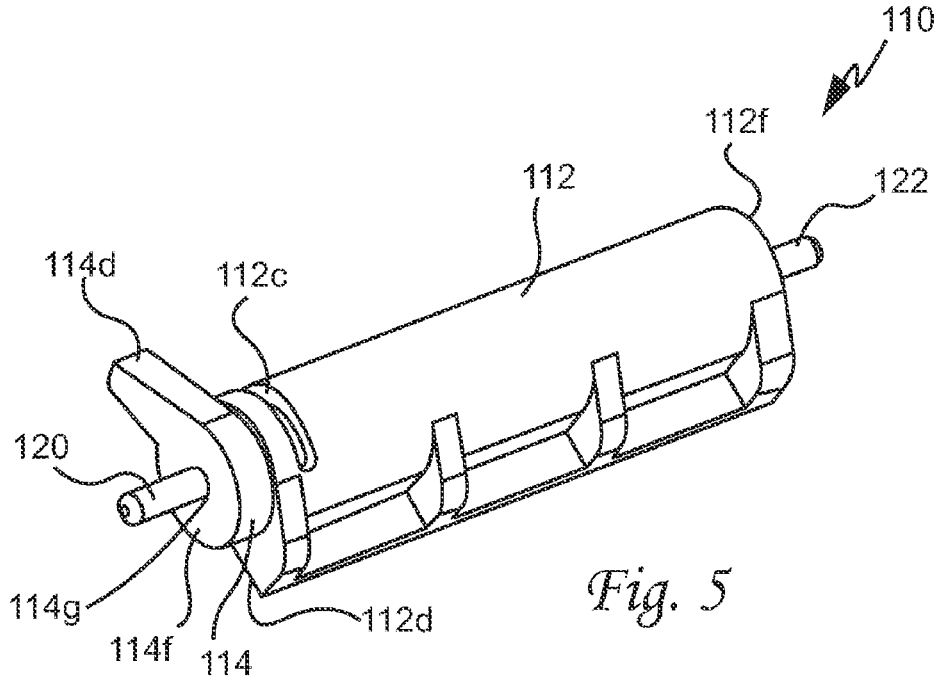
FIG. 5 is a perspective view of the hinge module of FIG. 4 in an assembled state.
Figure 6:
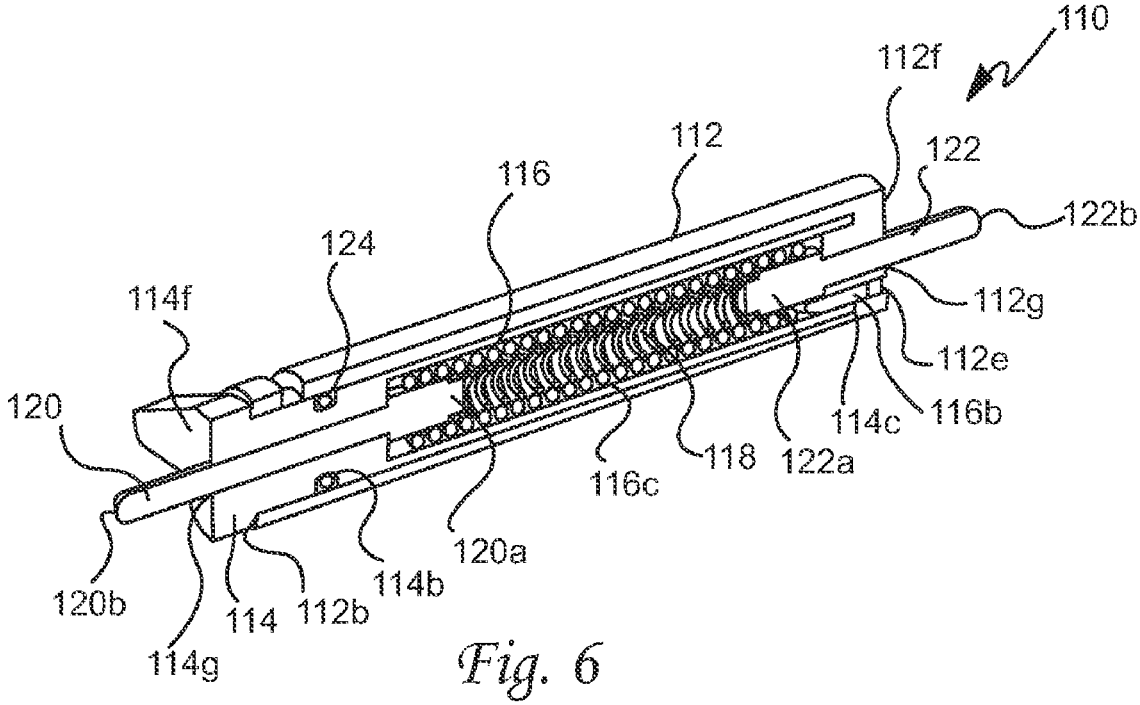
FIG. 6 is a cross-sectional view of the hinge module of FIG. 5.

Referring to FIGS. 4-6, a drop-in, damped hinge module 110 in accordance with a second preferred embodiment of the present invention is generally similar to the hinge module 10 of the first embodiment described above. The hinge module 110 includes an outer housing 112 and an inner housing 114 disposed therein. The outer and inner housings 112, 114 are rotationally coupled by a torsion spring 116.

Referring to FIG. 4, the outer housing 112 is generally tubular in shape with an interior surface 112*a* accessible through an open end 112*b*. Proximate the open end 112*b* is a generally circumferentially extending slot 112*c* extending at least partially around the outer housing 112. The outer housing 112 has an outer end 112*f*, which is preferably oppositely disposed from the open end 112*b*. The outer housing 112 further includes an engagement surface 112*d*, which is preferably a substantially flat portion extending along a side of the outer housing 112.

Still referring to FIG. 4, the inner housing 114 is also generally tubular in shape, having an open end 114*c* and an oppositely disposed outer end 114*f*. The inner housing 114 has an exterior surface 114*a*. Preferably, proximate the outer end 114*f* is a circumferential channel 114*b* within the inner housing 114. An engagement surface 114*d*, preferably in the form of a generally radially-extending lever, is preferably disposed at the outer end 114*f* of the inner housing 114.

Referring to FIGS. 4 and 6, the torsion spring 116 has first and second ends 116*a*, 116*b*. Each of the first and second ends 116*a*, 116*b* of the torsion spring 116 preferably extends axially from a coiled portion 116*c* of the torsion spring 116. Preferably, the first end 116*a* of the torsion spring 116 engages within a hole (not shown) proximate the outer end 114*f* of the inner housing 114, and the second end 116*b* of the torsion spring 116 engages within a hole 112*e* disposed in the outer end 112*f* of the outer housing 112 when the hinge module 110 is assembled, as described below.

Still referring to FIGS. 4-6, the hinge module 110 includes first and second pins 120, 122. Each of the first and second pins 120, 122 has an inner end 120*a*, 122*a* of a first diameter and an outer end 120*b*, 122*b* of a second diameter decreased from that of the inner end 120*a*, 122*a*. The outer ends 120*b*, 122*b* of the first and second pins 120, 122 are preferably sized to slidingly engage within apertures 114*g*, 112*g* of the inner and outer housings 114, 112, respectively. The diameters of the inner ends 120*a*, 122*a* are preferably greater than diameters of the apertures 114*g*, 112*g* to prevent the first and second pins 120, 122 from sliding completely through the apertures 114*g*, 112*g*. When assembled, the hinge module 110 further includes a compression spring 118 disposed between the inner ends 120*a*, 122*a* of the first and second pins 120, 122 to bias the first and second pins 120, 122 outwardly toward the outer ends 114*f*, 112*f* of the inner and outer housings 114, 112, respectively. Preferably, the diameters of the inner ends 120*a*, 122*a* and a diameter of the compression spring 118 are appropriately sized to fit within a hollow interior portion of the coiled portion 116*c* of the torsion spring 116 when the hinge module 110 is assembled.

The hinge module 110 further includes a seal 124, preferably in the form of an elastomeric O-ring, that is disposed within the channel 114*b* of the inner housing 114 in order to provide sealing engagement between the exterior surface 114*a* of the inner housing 114 and the interior surface 112*a* of the outer housing 112 when the hinge module 110 is assembled. It is also contemplated that the seal 124 provide a certain amount of rotational damping of the assembled hinge module 110.

Referring to FIGS. 4-6, to assemble the hinge module 110, the torsion spring 116 is inserted within the inner housing 114 such that the first end 116*a* of the torsion spring 116 is engaged within the hole in the inner housing 114. The first pin 120 is then inserted through the coiled portion 116*c* of the torsion spring 116 within the inner housing 114 so that the outer end 120*b* extends through the aperture 114*g* in the outer end 114*f* of the inner housing 114 with the inner end 120*a* remains within the inner housing 114 and the coiled portion 116*c* of the torsion spring 116, such that the inner end 120*a* is not disposed within the aperture 114*g*. The compression spring 118 is inserted within the coiled portion 116*c* of the torsion spring 116 within the inner housing 114 to abut the inner end 120*a* of the pin 120. The seal 124 is placed around the inner housing 114 within the channel 114*b*. The second pin 122 is inserted within the outer housing 112 so that the outer end 122*b* extends through the aperture 112*g* in the outer end 112*f* of the outer housing 112 and the inner end 122*a* remains within the outer housing 112. The outer housing 112 is then preferably placed around the inner housing 114, such that a majority of the inner housing 114 is disposed within the outer housing 112. By doing so, the inner end 122*a* of the second pin 122 is inserted within the coiled portion 116*c* of the torsion spring 116 to abut the compression spring 118, and the second end 116*b* of the torsion spring 116 is engaged within the hole 112*e* in the outer housing 112. In this way, the outer housing 112 is rotationally coupled to the inner housing 114 via the torsion spring 116, and the first and second pins 120, 122 are biased outwardly toward the outer ends 114*f*, 112*f*, respectively, by the compression spring 118 disposed therebetween.

Damping grease (not shown) is preferably disposed between the exterior surface 114*a* of the inner housing 114 and the interior surface 112*a* of the outer housing 112 and is maintained therebetween by the seal 124. Although it is preferred that the hinge module 110 include an O-ring seal 124, it is within the spirit and scope of the present invention that the hinge module 110 include a seal other than an elastomeric O-ring, such as a circumferentially extending ridge or bump Integral with one of the inner and outer housings 114, 112, a sealing tape or other such substance wrapped or otherwise adhered around the inner housing 114, or another suitable sealing means or that the seal be eliminated altogether to rely on the viscosity of the damping grease to retain the damping grease within the hinge module 110.

Preferably, a pin (not shown) is inserted through the slot 112*c* in the outer housing 112 to engage within a corresponding hole (not shown) in the inner housing 114. In this way, the outer housing 112 is retained on the inner housing 114. The pin rides within the slot 112*c* during rotation of the inner housing 114 with respect to the outer housing 112 with ends of the slot 112*c* defining rotational limits of the hinge module 110. Although it is preferred that a pin be used to attach the inner and outer housings 114, 112, it is within the spirit and scope of the present invention that another suitable structure be used, such as, but not limited to, a raised rib integral with the inner housing 114, as was described above with respect to the first embodiment, provided the hinge module 110 is still capable of performing as described herein.

The hinge module 110 is preferably preassembled to form a stand-alone unit, as shown in FIG. 5, to avoid the necessity of assembling the hinge module 110 during assembly of the device or object in which the hinge module 110 is to be installed. In this way, the hinge module 110 can simply be "dropped into" a device, thereby facilitating assembly of the device. This is accomplished by applying force to the outer ends 120*b*, 122*b* of the first and second pins 120, 122 directed inwardly to compress the compression spring 118 between the first and second pins 120, 122 and force the outer ends 120*b*, 122*h* into the inner and outer housings 114, 112, respectively. Doing so provides enough clearance between the hinge module 110 and the device to allow the hinge module 110 to be "dropped into" a mounting location (not shown) of the device. Once "dropped in", the compression spring 118 expands axially to its normal uncompressed length to push the outer ends 120*b*, 122*b* of the first and second pins 120, 122 outwardly into corresponding holes (not shown) in the device to retain the hinge module 110 within the device. When installed, the engagement surfaces 112*d*, 114*d* of the hinge module 110 abut corresponding engagement surfaces (not shown) of a lid (not shown) and a base (not shown) of the device. In this way, the engagement surface 112*d* of the outer housing 112 engages and rotationally couples the outer housing 112 with one of the lid and the base, and the engagement surface 114*d* of the inner housing 114 engages and rotationally couples the inner housing 114 with the other of the lid and the base of the device. Although this method of installation into and rotational coupling with the device is preferred, it is within the spirit and scope of the present invention that the hinge module 110 be rotationally coupled with the device or installed in a different manner, provided the hinge module 110 is still capable of performing in the manner described herein.

Preferably, the outer and inner housings 112, 114 are formed of a polymeric material and the first and second pins 120, 122, torsion spring 116, and compression spring 118 are made from a metallic material. Specifically, it is preferred that the outer and inner housings 112, 114 be injection molded out of a plastic material, such as a PC/ABS blend, for instance, although many other resins could be used instead. Additionally, although it is preferred that the first and second pins 120, 122 be made from a metallic material, it is contemplated that the first and second pins 120, 122 be made from a polymeric material, provided the first and second pins 120, 122 are still able to perform as described herein. Although this is preferred, it is within the spirit and scope of the present invention that the outer and inner housings 112, 114; the first and second pins 120, 122; the torsion spring 116; and the compression spring 118 be formed from other suitable materials using other manufacturing processes, provided the hinge module 110 is still capable of functioning as described herein.

In use, the hinge module 10, 110 is capable of relatively easy, "drop-in" installation within an object, as described above, to facilitate assembly of the object. Once installed, the assembled hinge module 10 (FIGS. 1-3), 110 (FIGS. 4-6) allows for damped rotation of the lid with respect to the base of an object. The torsion spring 16, 116 biases the inner housing 14, 114 in a direction of arrow A with respect to the outer housing 12, 112. The damping grease between the exterior surface 14*a*, 114*a* of the inner housing 14, 114 and the interior surface 12*a*, 112*a* of the outer housing 12, 112 damps the rotation of the hinge module 10, 110 to provide generally constant-speed rotational motion.

Preferably, the hinge module 10, 110 is placed within the object so that the direction of opening of the object coincides with arrow A (see FIG. 1 for hinge module 10 and FIG. 4 for hinge Module 110) to bias the object in the open position. A latch (not shown) is disposed between the lid and the base of the object in order to retain the object in the closed position. In this way, unlatching of the latch allows the hinge module 10, 110 to provide generally constant-speed rotation of the lid into the open position. The hinge module 10, 110 is preferably used in cosmetic cases but also has applicability in other clamshell-type cases and devices, such as eyeglass cases and cell phones, for instance, and any other device or object in which damped rotational motion is desired.

Referring to FIGS. 7-13, there is shown a third preferred embodiment of a drop-in, damped hinge module, indicated generally at 210, in accordance with the present invention. The hinge module 210 preferably includes generally tubular outer and inner housings 212, 214. The inner housing 214 is preferably sized to fit snugly within the outer housing 212. The outer housing 212 has an open end 212*b* that allows access to an interior surface 212*a* of the outer housing 212. Similarly, the inner housing 214 has an open end 214*c* to allow access to an interior 214*f* of the inner housing 214. Preferably, a hole 214*b* is disposed within an end opposite the open end 214*c* of the inner housing 214. The hole 214*b* is eccentric, i.e. the hole 214*b* is off center relative to the central longitudinal axis of the interior 214*f* of the inner housing 214. The inner housing 214 further includes an exterior surface 214*a*.

Referring, to FIGS. 7-13, to assemble the hinge module 210, a torsion spring 216, appropriately sized to fit into the open end 214*c* of the inner housing 214, is preferably disposed at least in part within the inner housing 214. A generally axial first projection 216*a* provided at a first end 216*d* of the torsion spring 216 that fits within the hole 214*b* of the inner housing 214 to rotationally couple the inner housing 214 with the first end 216*d* of the torsion spring 216. The outer housing 212 is then placed over the inner housing 214 and the torsion spring 216 so that a second axial projection 216*b*, provided at a second end 216*e* opposite the first end 216*d* of the torsion spring 216, engages within a hole 212*e* in the outer housing 212 to rotationally couple the outer housing 212 with the second end 216*e* of the torsion spring 216. The inner housing 214 preferably snaps into the outer housing 212 to hold the hinge module 210 together as a single integrated unit. Preferably, this is accomplished by providing two arc-shaped slots 211, 213 in the bottom of the interior 212*h* opposite the open end 212*b* of the outer housing 212 that receive, respectively, the axially projecting snap legs 215, 217 in a snap-fit fashion to inhibit the inner housing 214 and the outer housing 212 from being pulled apart while permitting the two to be moved rotationally relative to each other.

Figure 10:
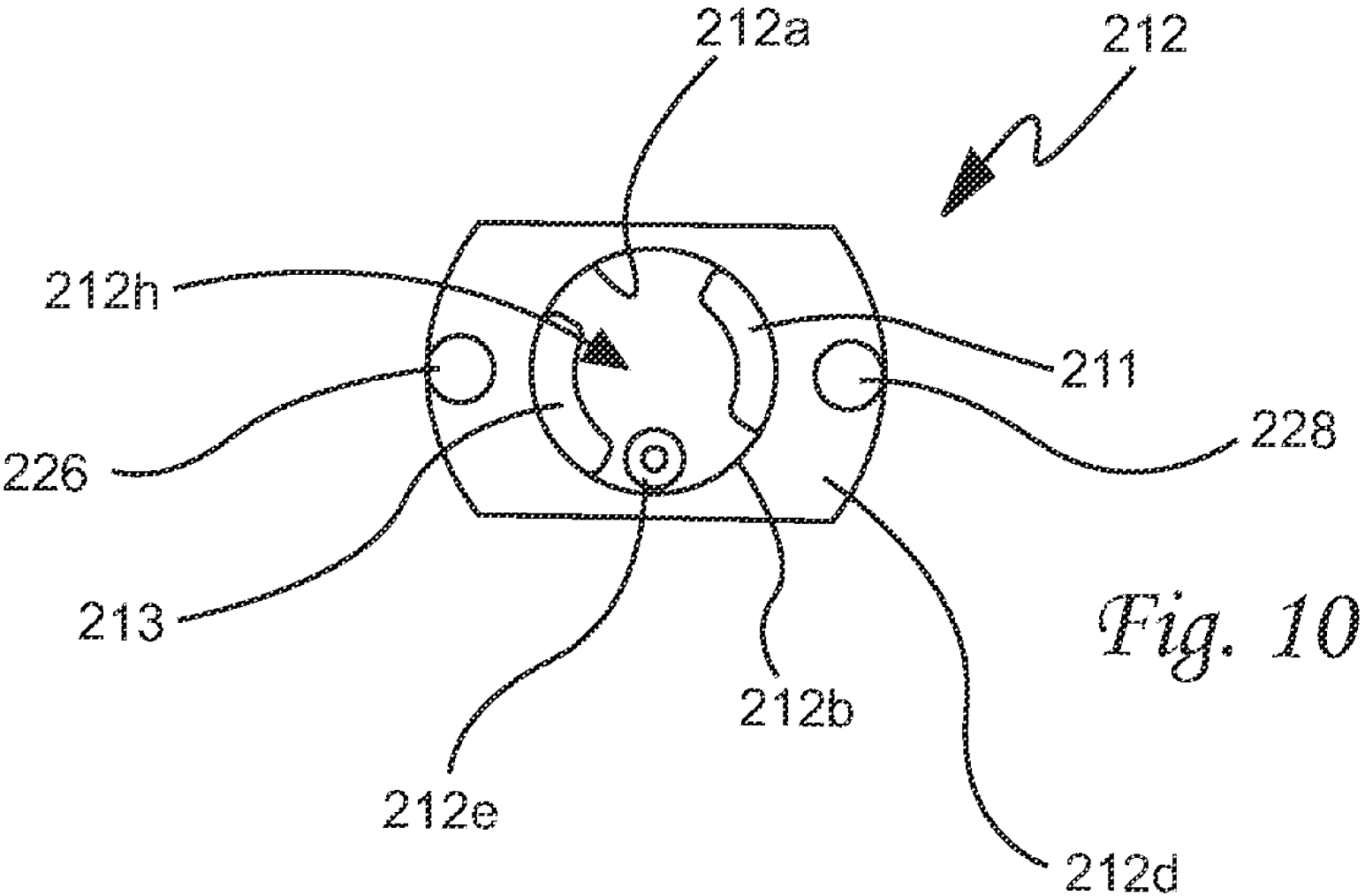
Figure 11:
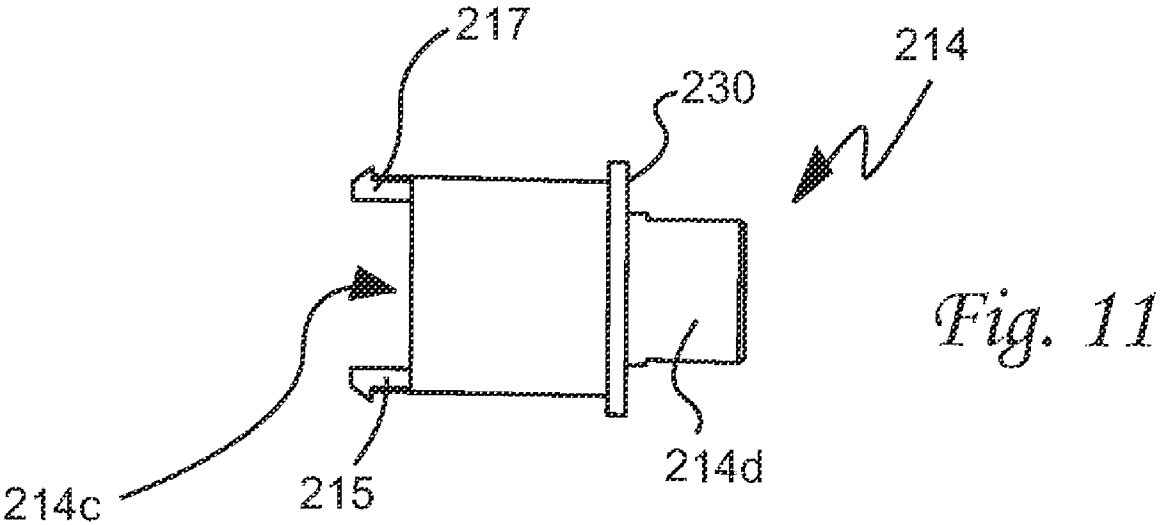
Figure 12:
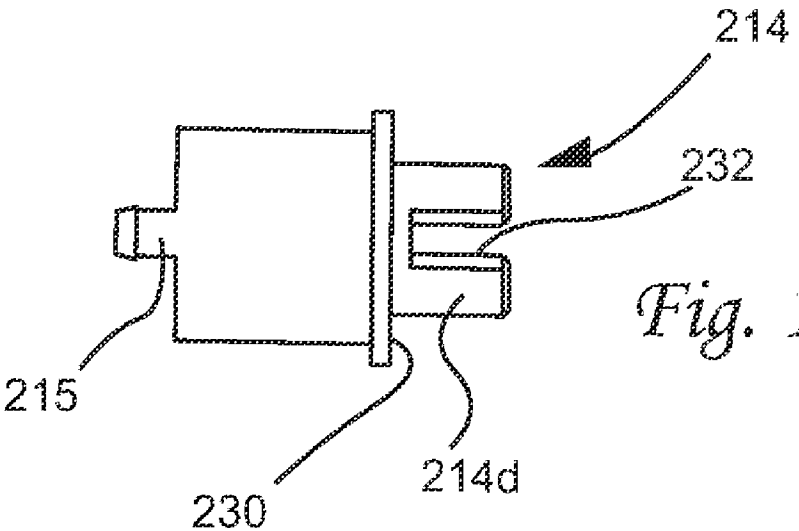
Figure 13:
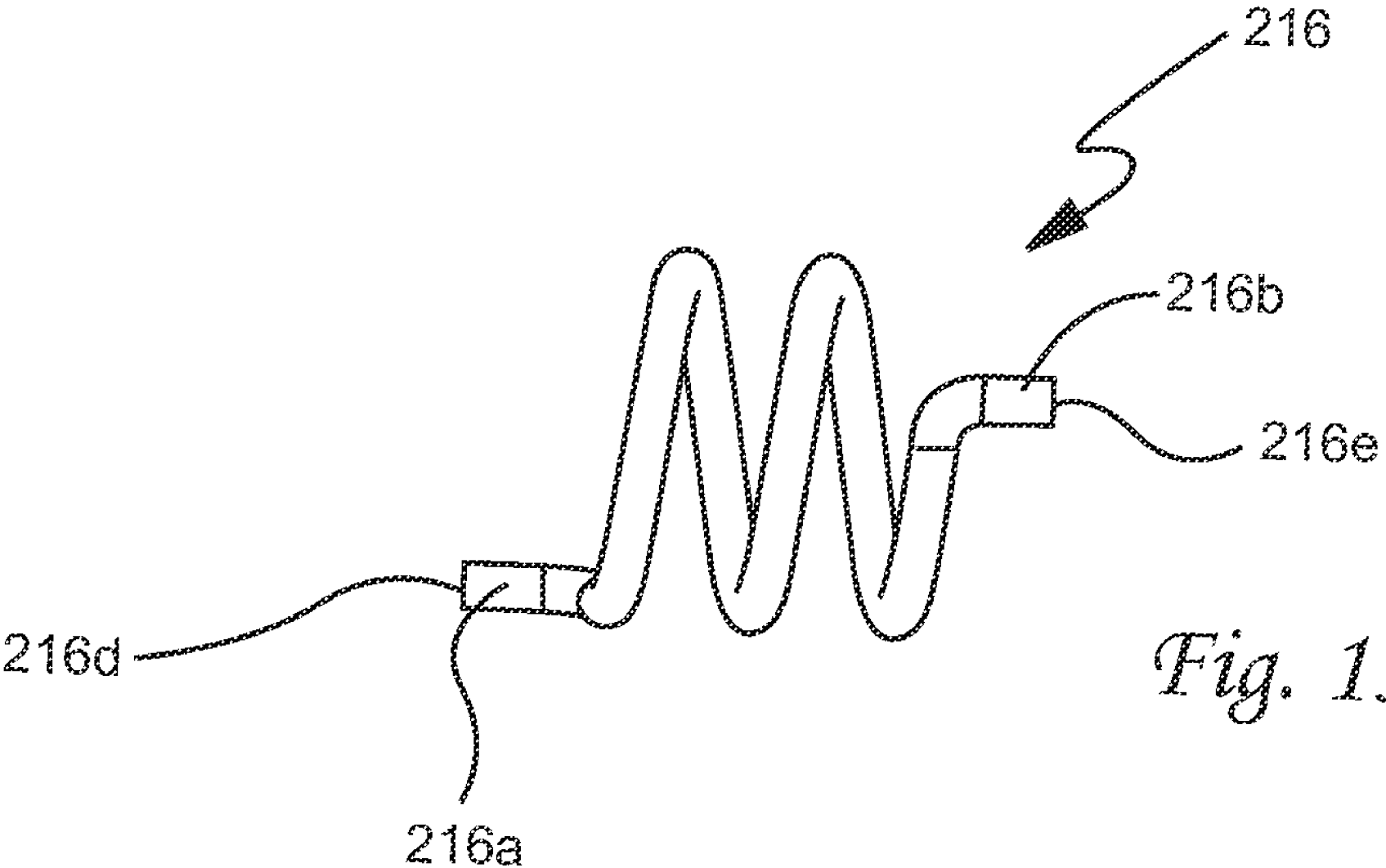
Figure 14:
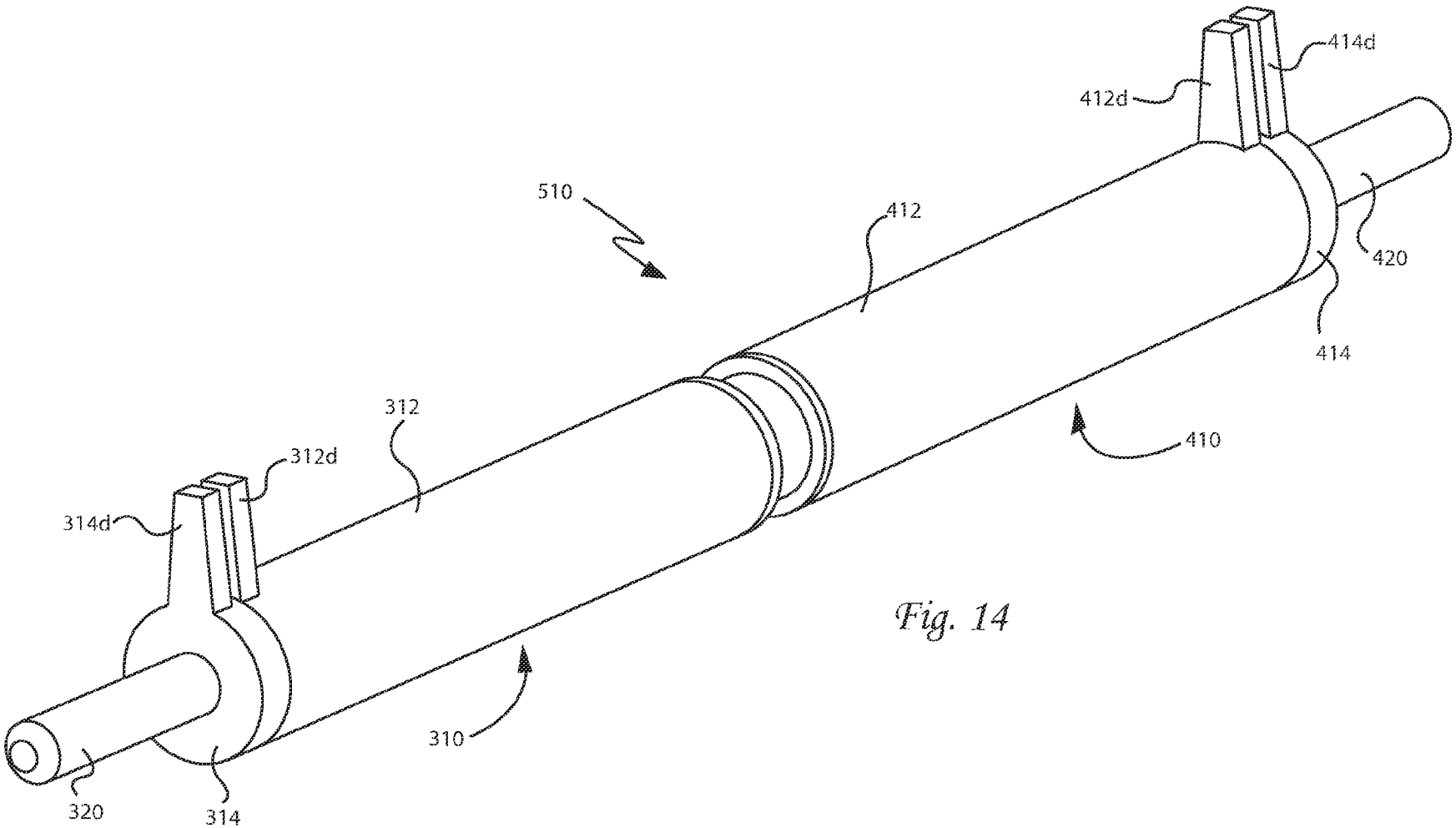
FIGS. 14-24 are views of a hinge module in accordance with a fourth preferred embodiment of the present invention.
Figure 15:
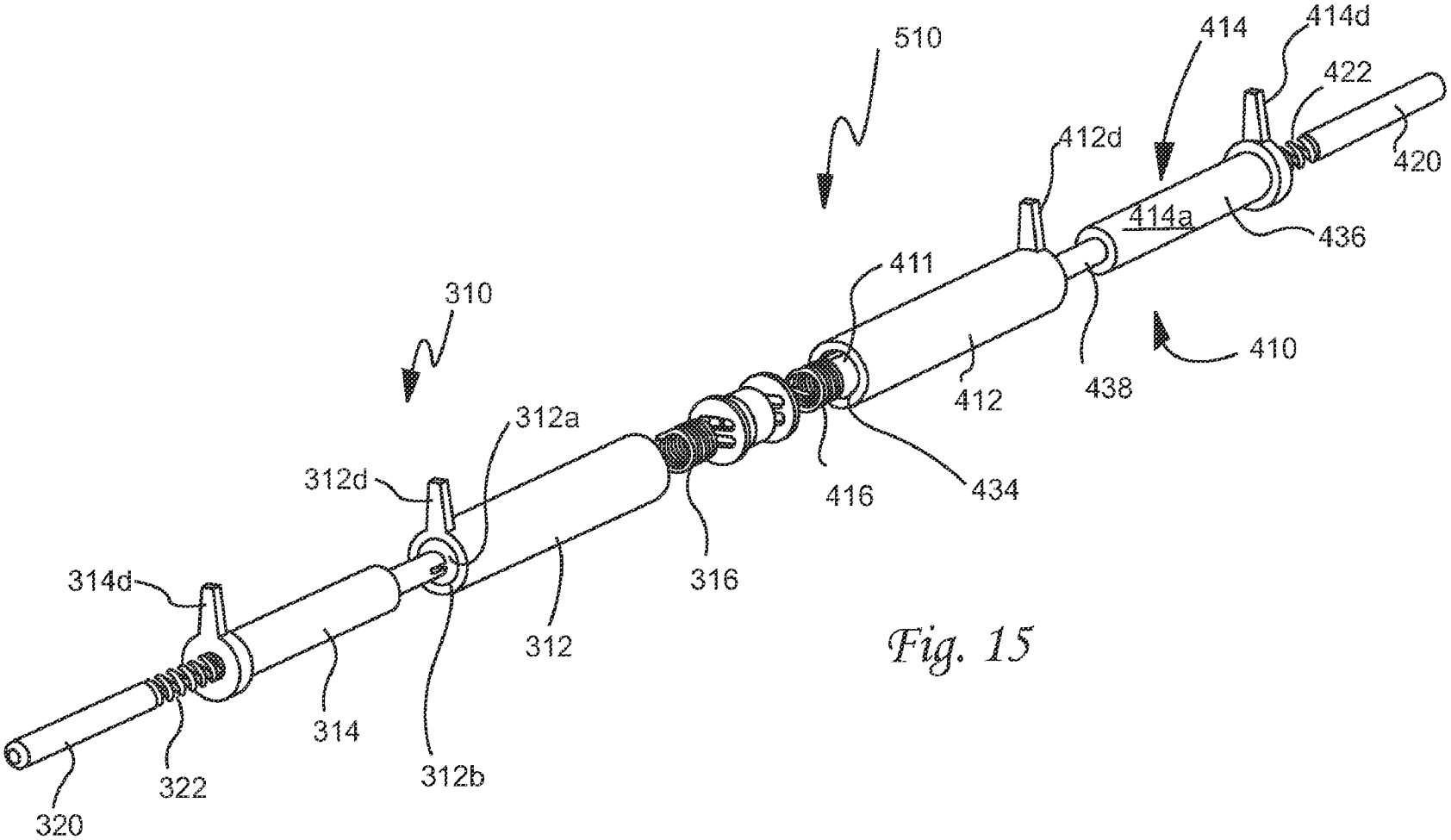
Figure 16:
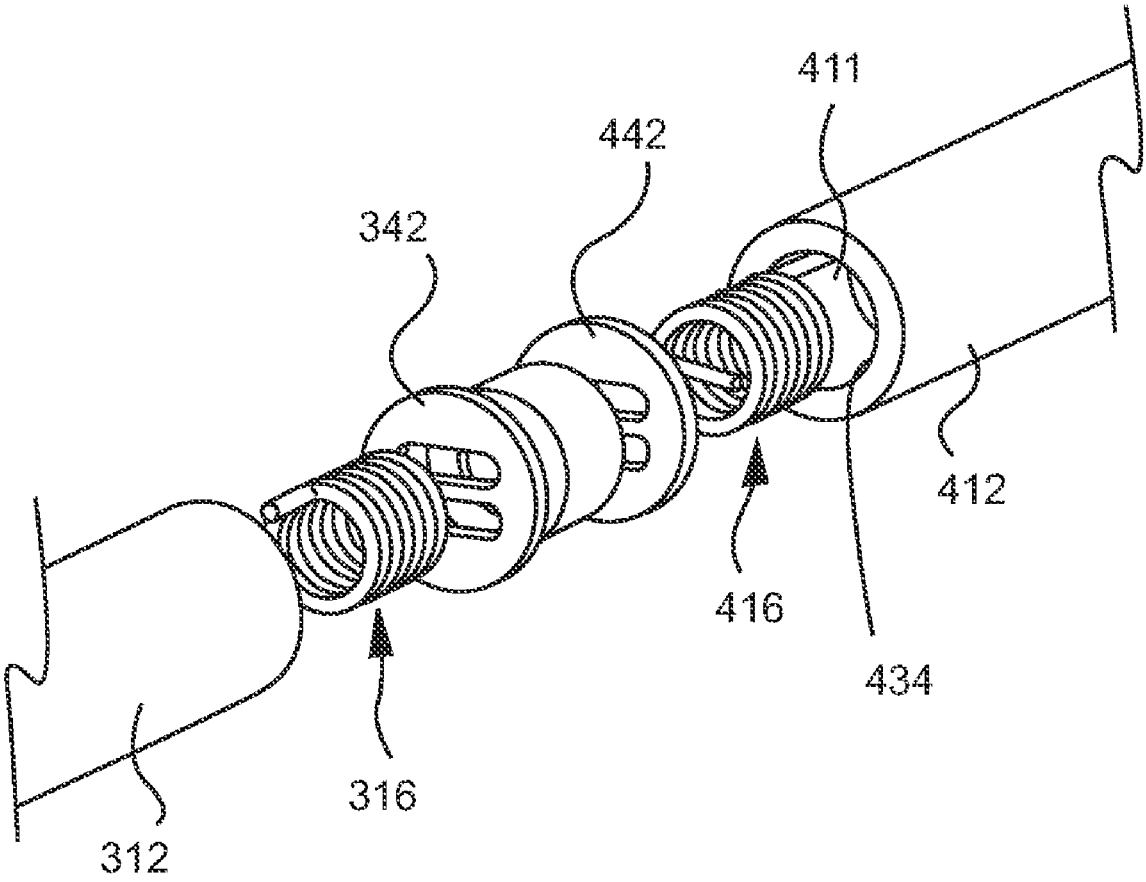
Figure 17:
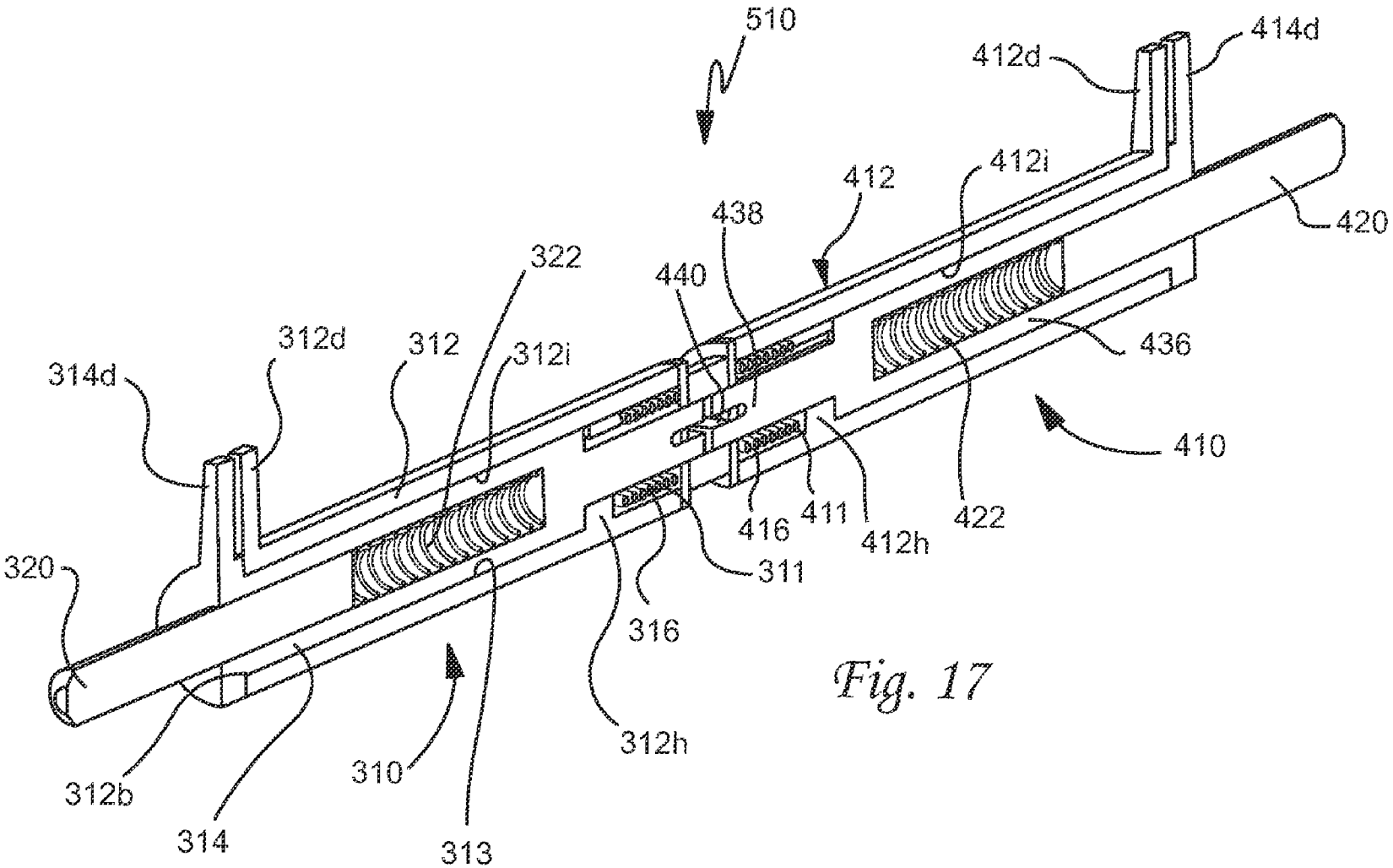
Figure 18:
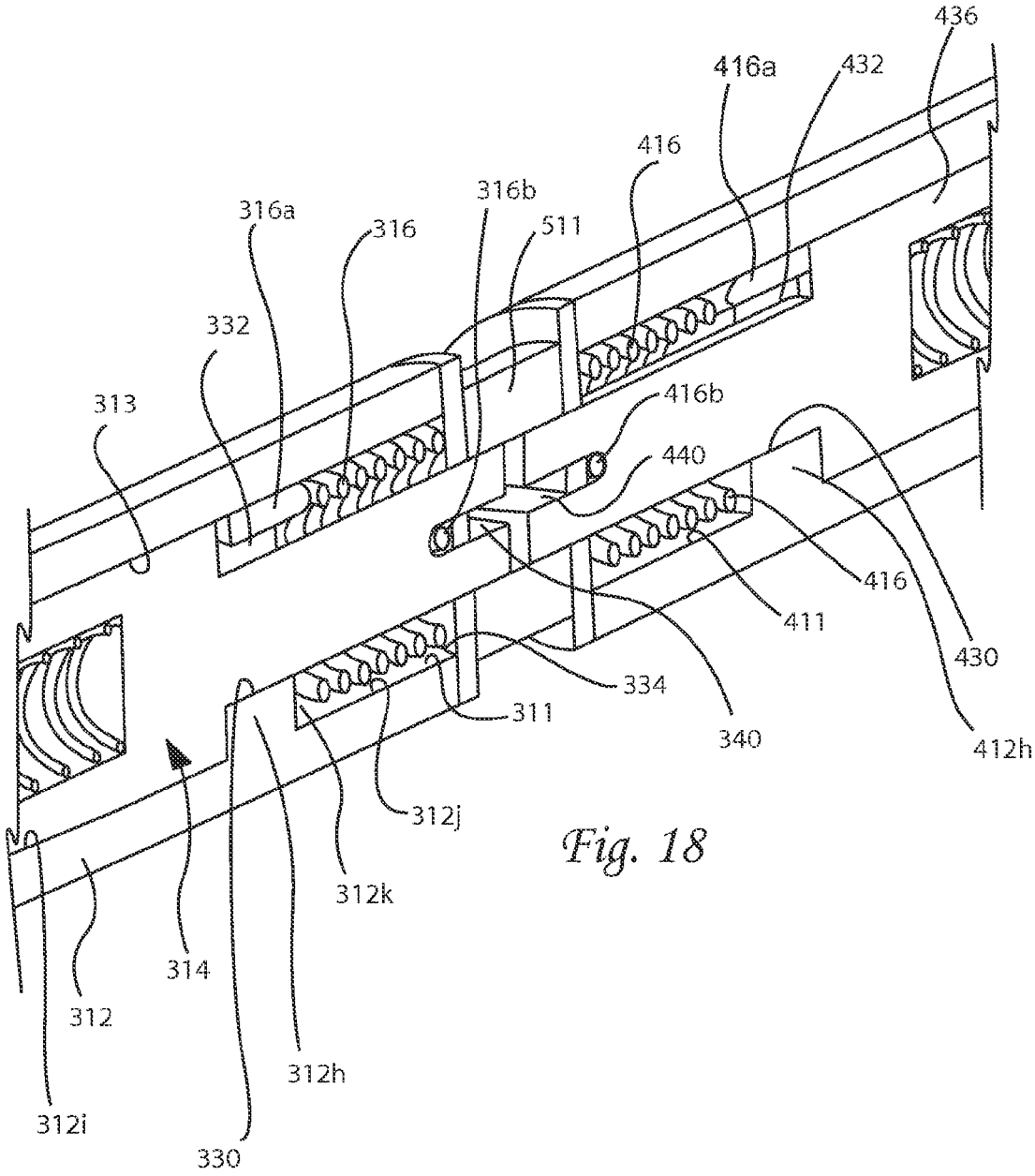
Figure 20:
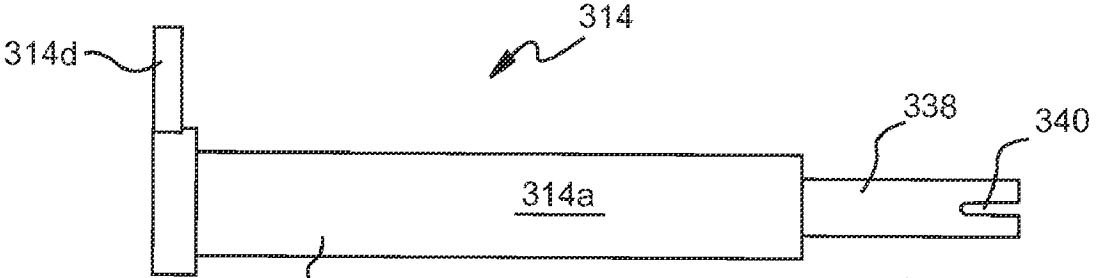
Figure 21:
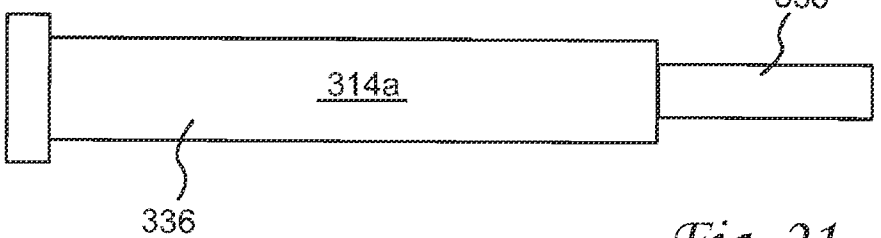
Figure 19:
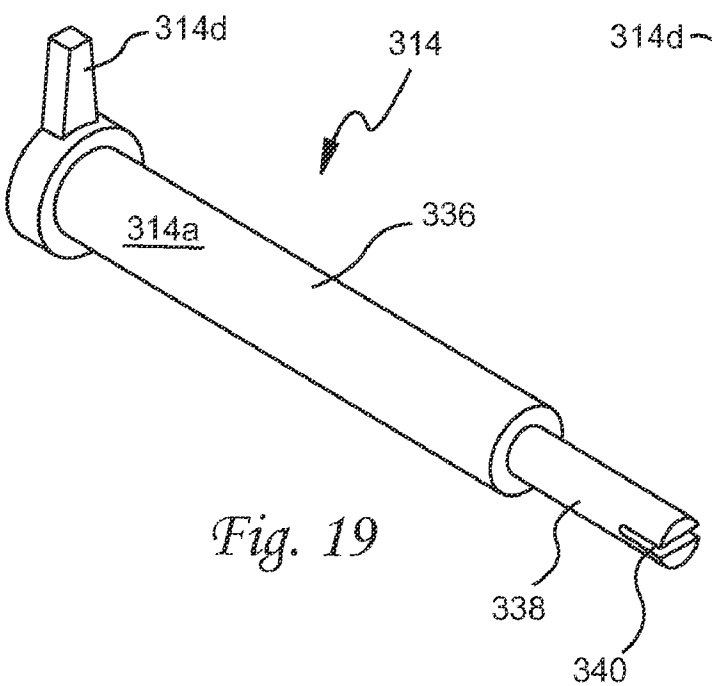
Figure 24:
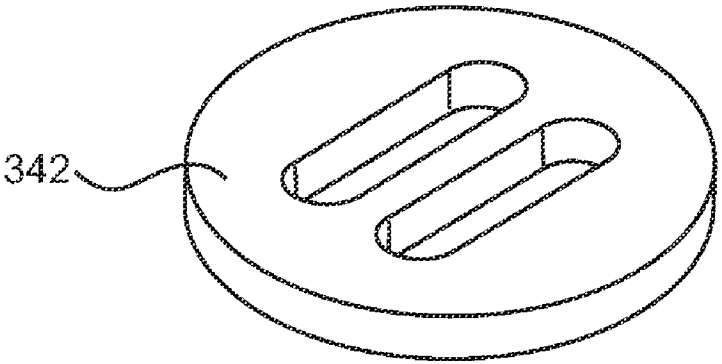
Figure 23:
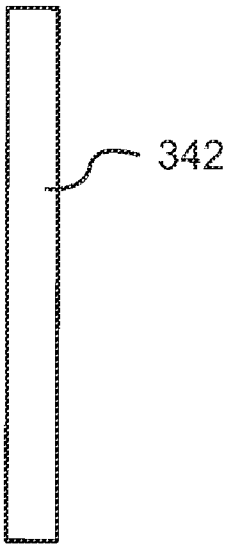
Figure 22:
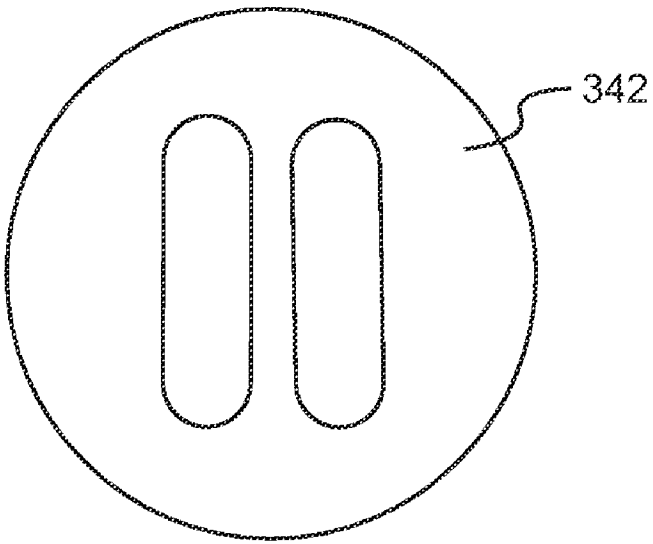
Figure 25:
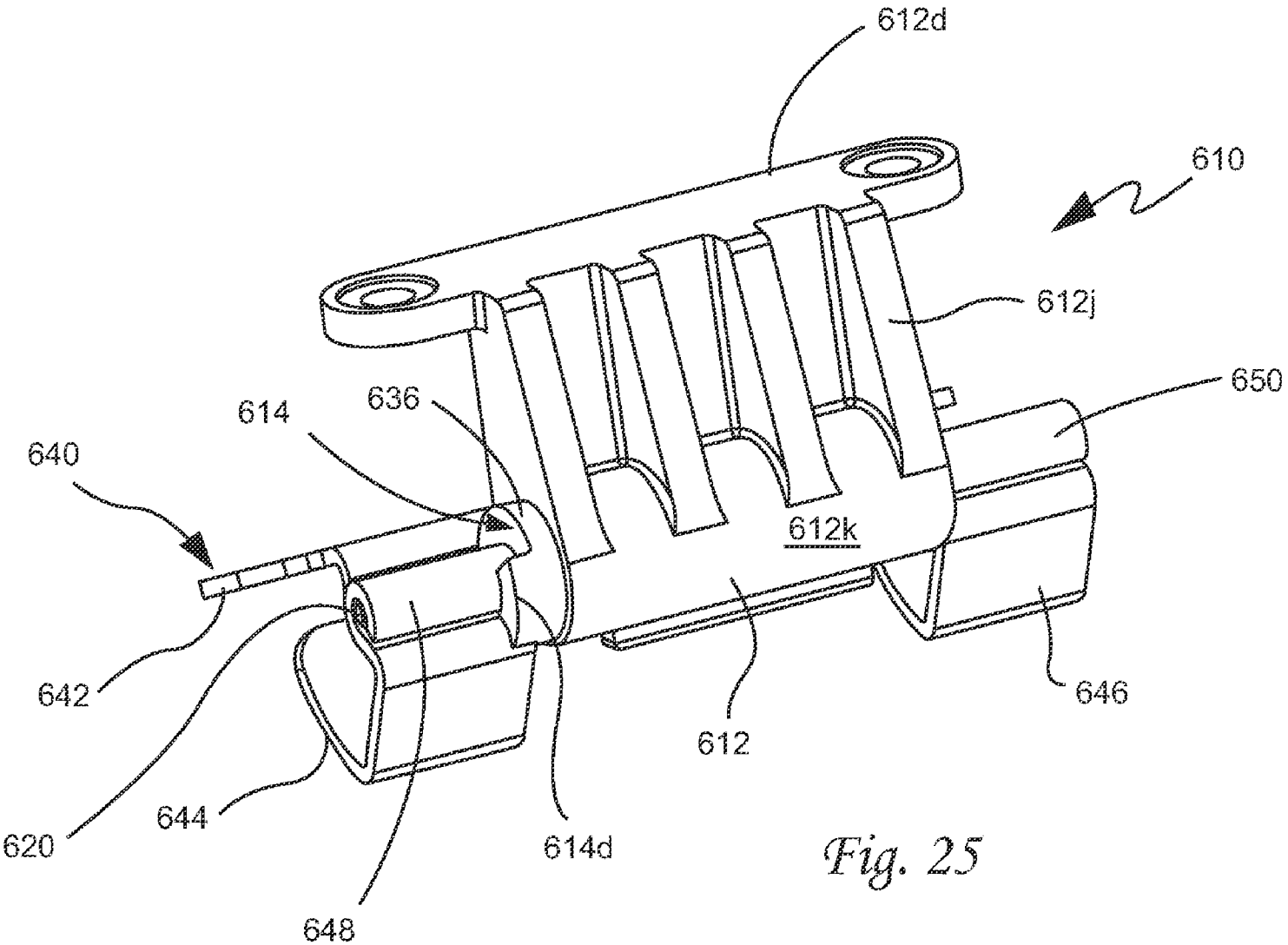
FIGS. 25-28 are views of a hinge module in accordance with a fifth preferred embodiment of the present invention.
Figure 26:
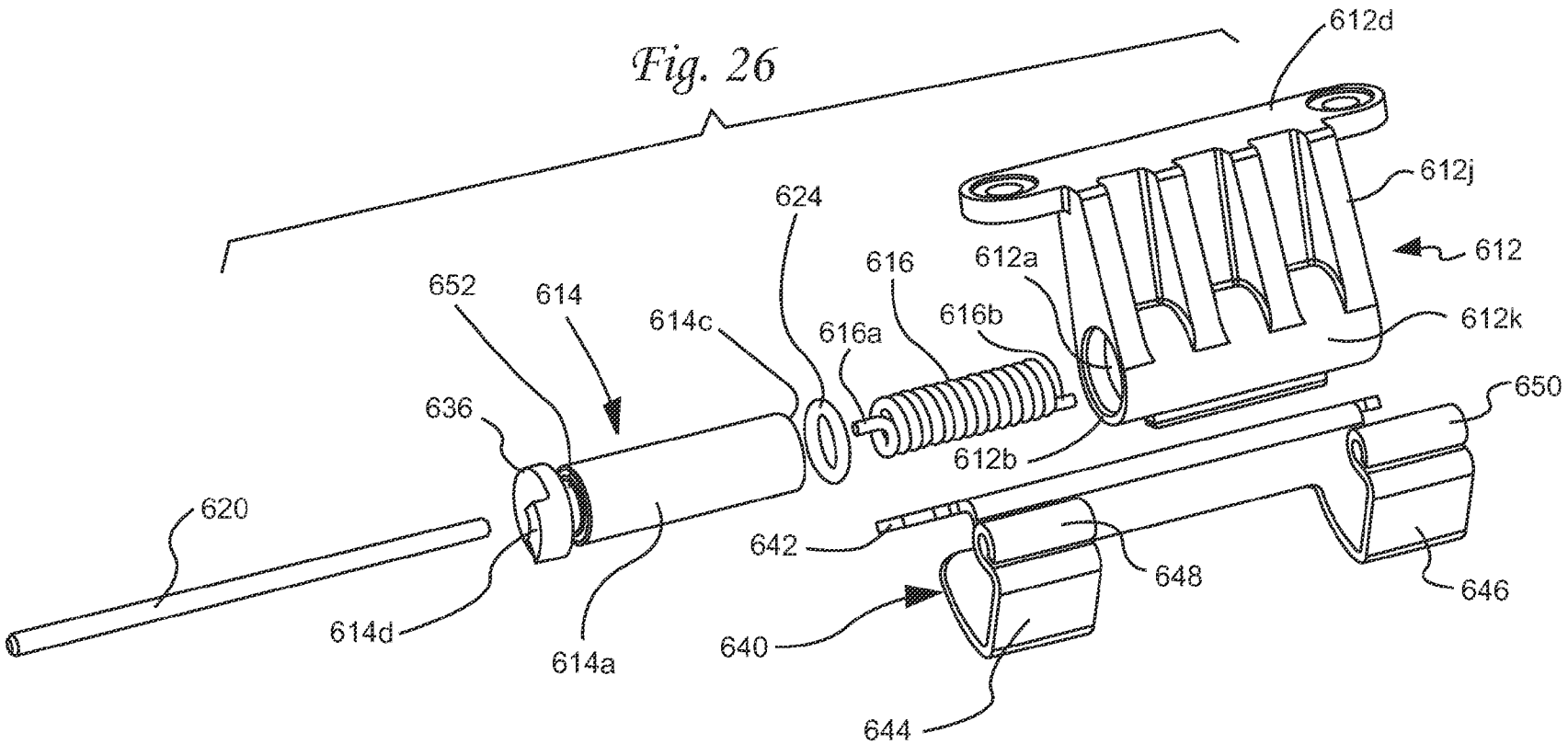
Figure 27:
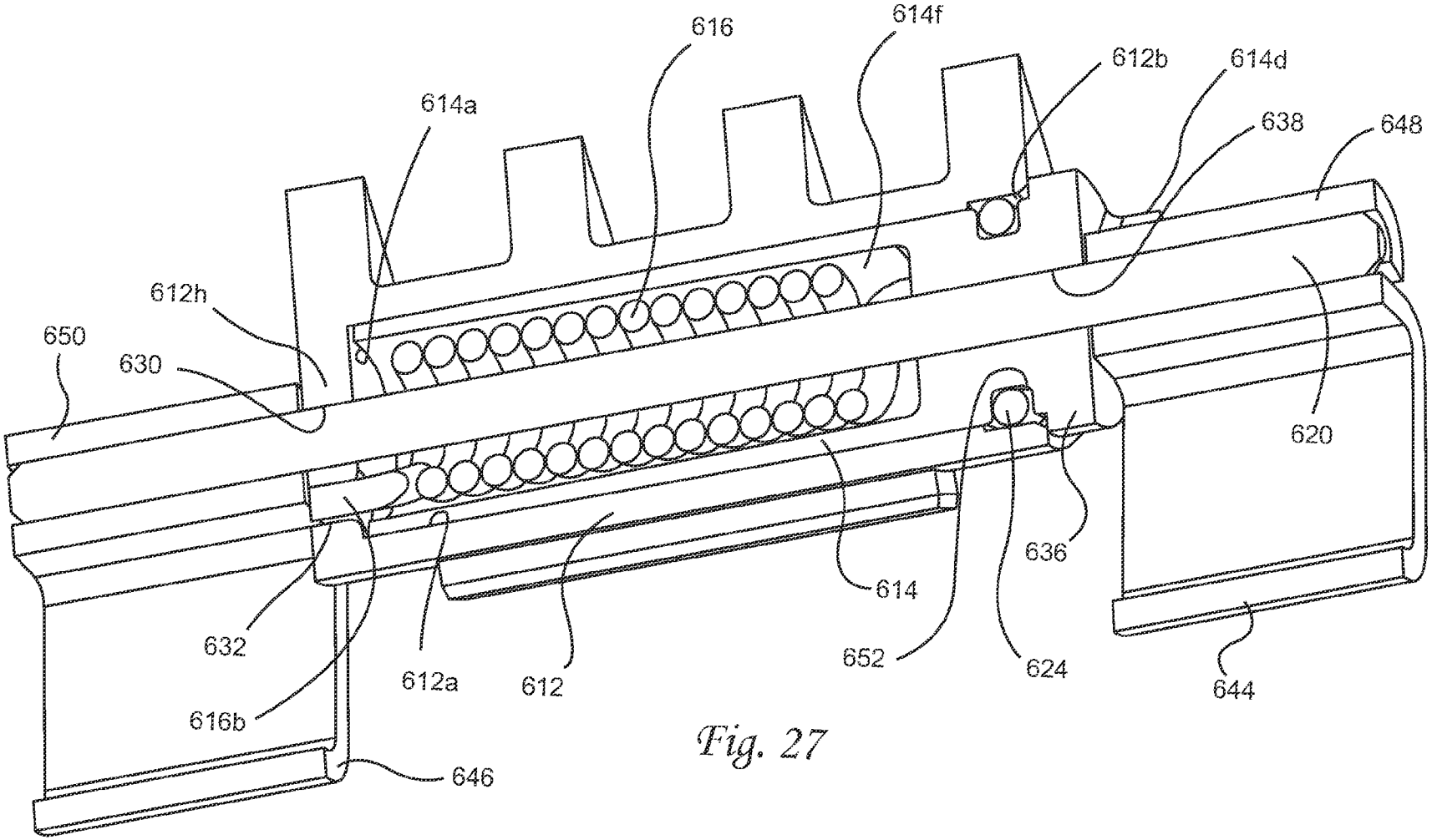
Figure 28:
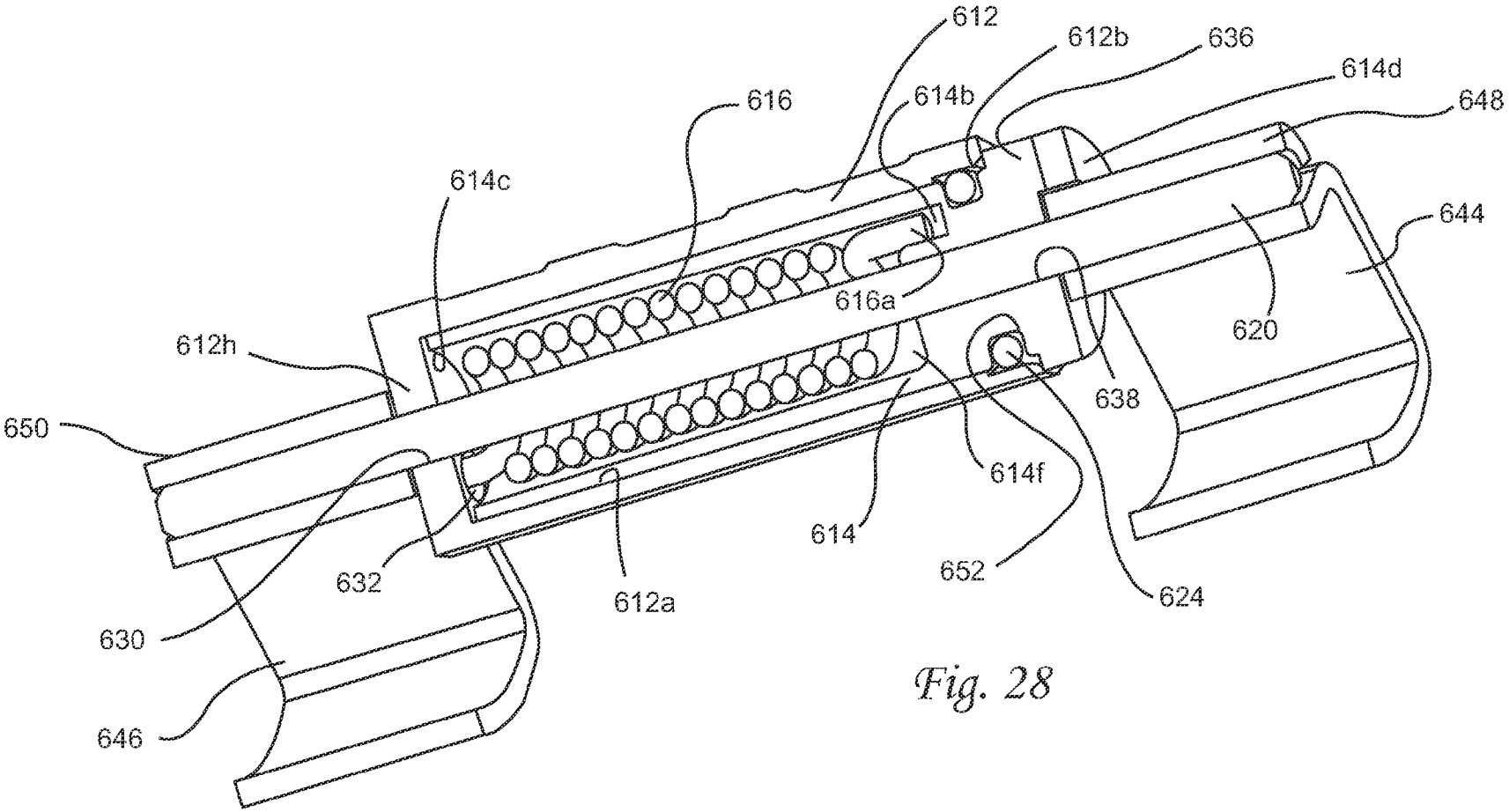

Referring, specifically to FIGS. 10-12, the length of the slots 211, 213 is substantially longer than the width of the snap legs 215, 217 along the circumference of the open end 212*b* of the outer housing 212. This configuration allows the inner housing 214 to rotate a certain amount with respect to the outer housing 212 as the snap legs 215, 217 ride in the slots 211, 213, respectively.

Additionally, damping grease (not shown) is preferably applied and provided between the exterior surface 214*a* of the inner housing 214 and the interior surface 212*a* of the outer housing 212. The outer and inner housings 212, 214 each have engagement surfaces to allow the hinge module 210 to engage a lid (not shown) and a base (not shown) of an object (not shown) in which the hinge module 210 is to be used.

Figure 7:
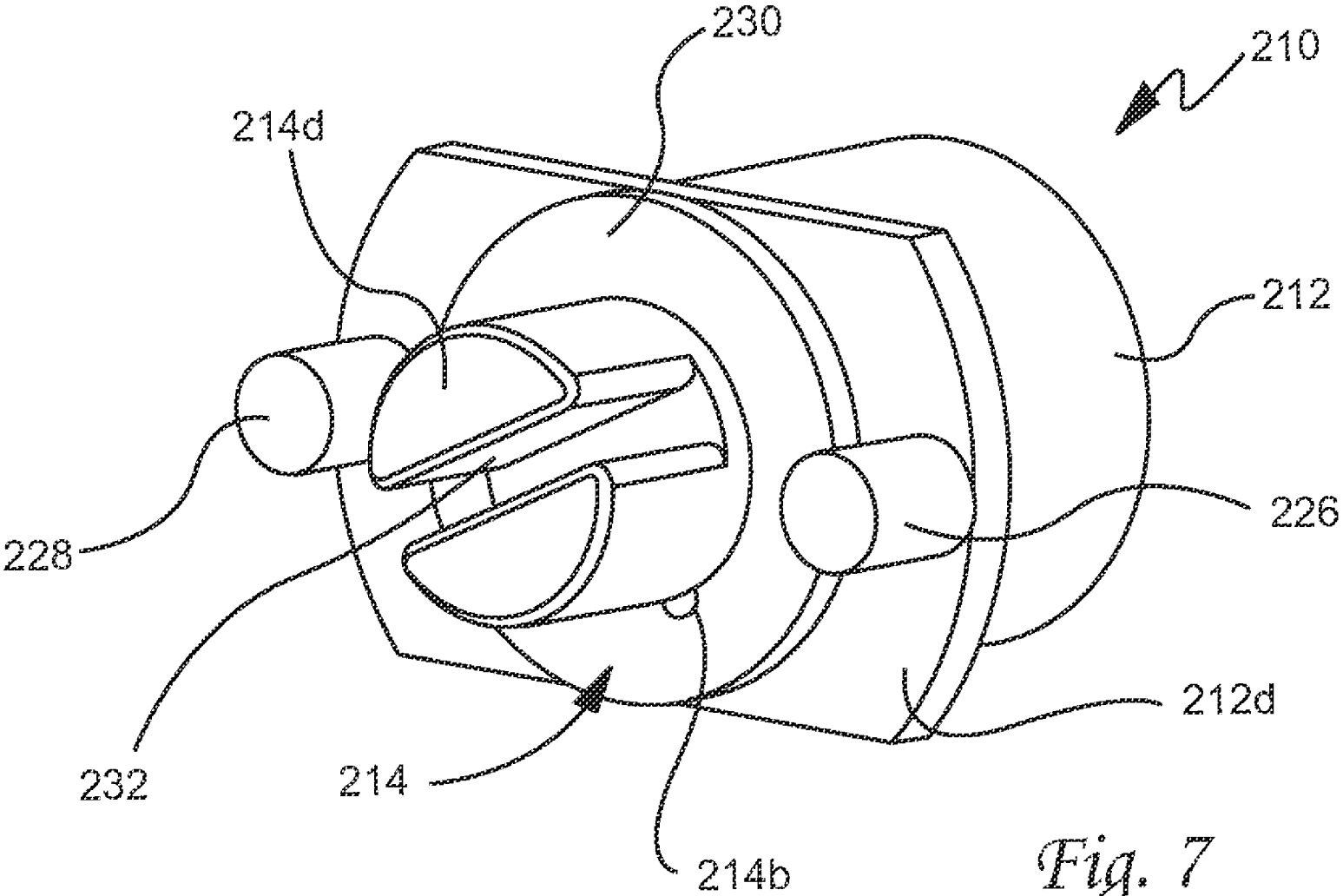
FIGS. 7-13 are views of a hinge module in accordance with a third preferred embodiment of the present invention.
Figure 8:
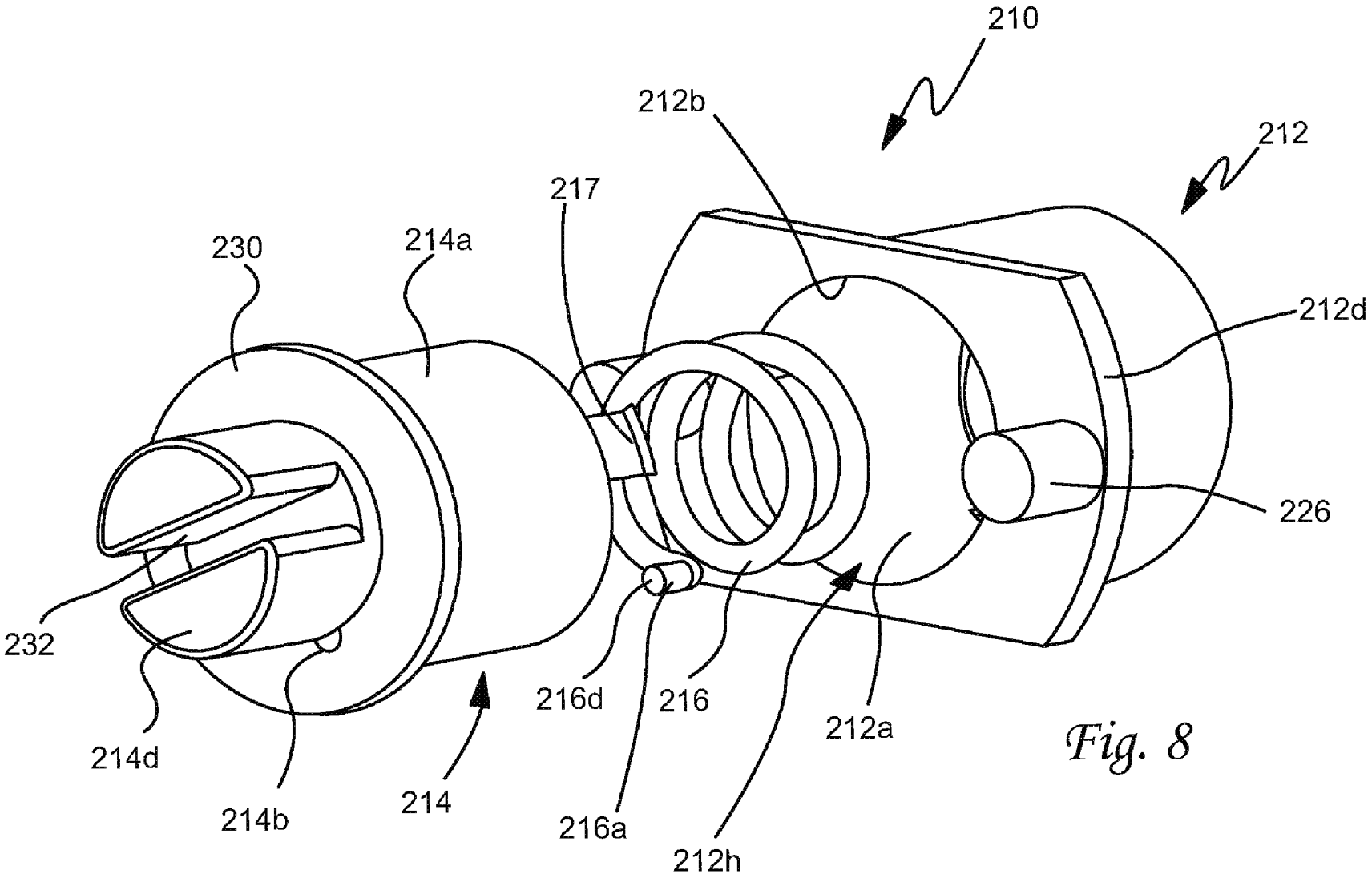
Figure 9:
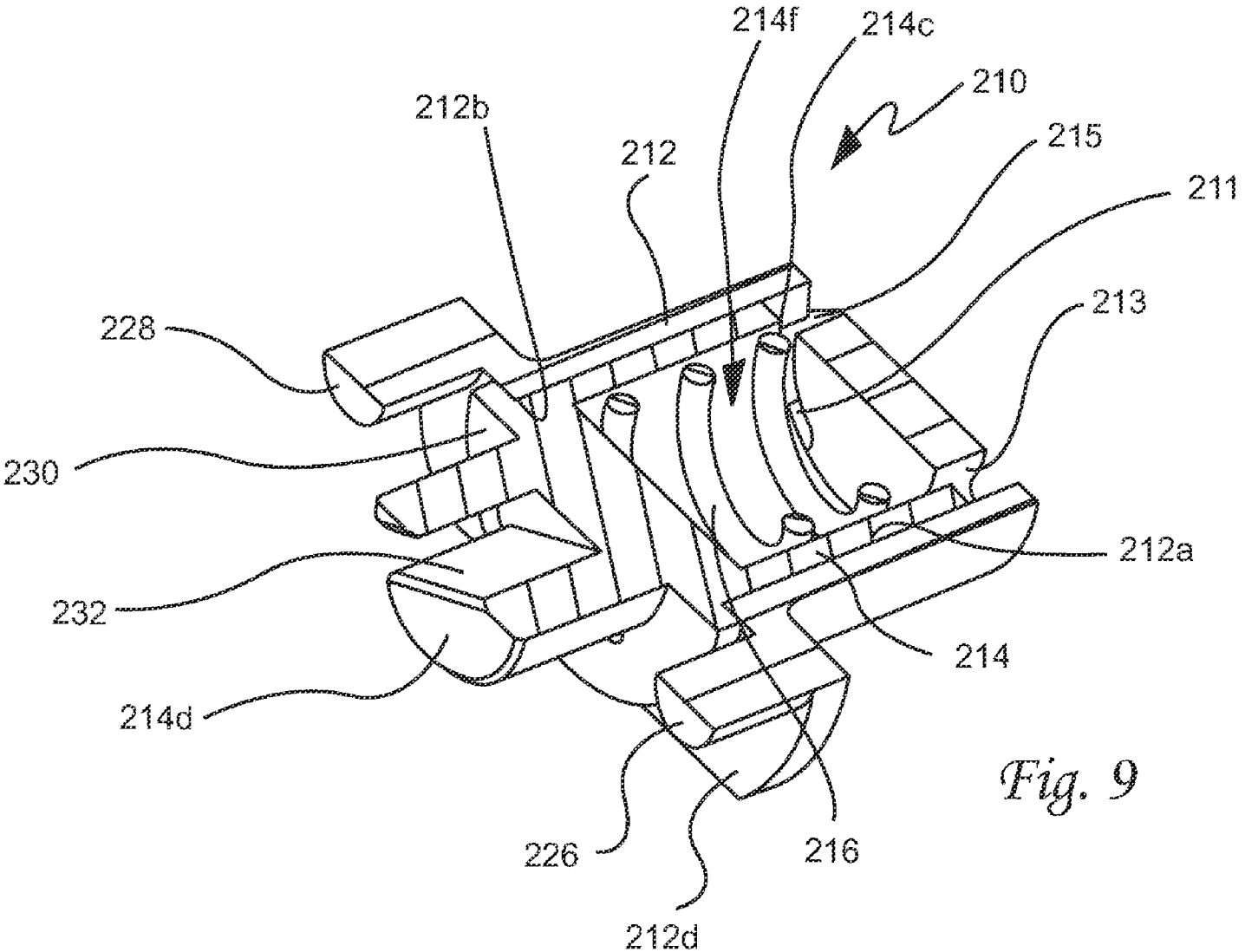

The hinge module 210 is preferably preassembled to form a stand-alone unit, as shown in FIG. 7, to avoid the necessity of assembling the hinge module 210 during assembly of the object in which the hinge module 210 is to he installed. In this way, the hinge module 210 can simply be "dropped into" an object, thereby facilitating assembly of the object. In the illustrated example, the engagement surfaces of the outer housing 212 comprise a flange 212*d* near the open end 212*b* of the outer housing 212 and a pair of cylindrical, axial projections 226, 228 projecting in parallel from the flange 212*d* on either side of open end 212*b* of the outer housing 212. The engagement surfaces 212*d*, 226 and 228 of the outer housing 212 engage and rotationally couple the outer housing 212 with one of the lid and the base. In the illustrated example, the inner housing 214 includes an axial projection 214*d*, projecting outward from the outer end 230 of the inner housing 214, that is provided with a slot 232. The slot 232 constitutes the engagement surfaces of the inner housing 214. The engagement surfaces 232 of the inner housing 214 engage and rotationally couple the inner housing 214 with the other of the lid and the base of the object.

The inner housing 214 is rotationally movable relative to the outer housing 212 between a first position and a second position. The torsion spring 216 biases the inner housing toward the first position and is preloaded to keep the inner housing 214 in the first position with at least some force. As the inner housing 214 is rotated toward the second position, the torsion spring 216 is more tightly wound up and thus provides an increasing biasing force tending to return the inner housing 214 to the first position. The rotational motion of the inner housing relative to the outer housing is stopped once the inner housing is in the second position. If the inner housing 214 is then released, the biasing force of the torsion spring 216 returns the inner housing 214 to its first position while the damping grease ensures that the rotational motion of the inner housing 214 toward the first position due to spring bias is smooth and of controlled speed within a desirable range.

As an example of the application of the hinge module 210, the outer housing 212 can be coupled to the base mentioned previously such that the projection 214*d* is in registry with an opening in the base and such that the first position of the inner housing 214 corresponds to the open position of the lid. The lid would then be provided with a rectangular bar that projects from the lid and is coaxial with the axis of rotation of the lid. The rectangular bar projecting from the lid can then be inserted in the slot 232 with the lid in the open position to provide a hinge coupling between the lid and the base. Due to the preload of the spring 216, the lid will be held in the open position with at least some force. The lid will then have to be moved to the closed position against the spring bias provided by the torsion spring 216, thus storing energy in the torsion spring 216. The lid would be kept in the closed position by a separate latch (not shown). When the latch is opened then the lid automatically moves to the open position under the bias of torsion spring 216, but in a controlled and smooth manner due to the damping effect of the damping grease.

Preferably, the outer and inner housings 212, 214 are formed of a polymeric material and the torsion spring 216 is made from a metallic material. Specifically, it is preferred that the outer and inner housings 212, 214 be injection molded out of a plastic material, such as a PC/ABS blend, for instance, although many other resins could be used instead. Although this is preferred, the outer and inner housings 212, 214 and the torsion spring 216 may be formed from other suitable materials and using other suitable manufacturing processes.

Referring to FIGS. 14-24, a damped hinge module 510 in accordance with a fourth preferred embodiment of the present invention can be seen. The hinge module 510 is made of two separate hinge modules 310 and 410 that are essentially identical and are placed in end to end arrangement as will be described below. The hinge module 310 includes a first outer housing 312 and a first outer shaft 314 disposed in substantial part in the first outer housing 312. The first outer housing 312 and the first outer shaft 314 are rotationally coupled by a first torsion spring 316.

The first outer housing 312 is generally tubular and has a bore that is partitioned by a wall 312*h* into a torsion spring compartment 311 and a sleeve portion compartment 313. The compartment 313 has an interior 312*i* having an interior surface 312*a* and is accessible through an opening 312*b* opposite the wall 312*h*. The compartment 311 has an interior 312*j* having an interior surface 312*k* and is accessible through an opening 334 opposite the wall 312*h*. The wall 312*h* has a center hole 330 extending through the wall 312*h* and a slot 332 to one side of the center hole 330. An arm 312*d* projects from the exterior surface of the first outer housing 312 proximate the opening 312*b* and the arm 312*d* extends along a plane that is generally transverse to the central longitudinal axis of the first outer housing 312.

The outer shaft 314 has a tubular sleeve portion 336 with a hollow bore and a solid shaft portion 338 with a slot 340 at the end of the solid shaft portion that is farthest from the sleeve portion. The tubular sleeve portion 336 has a larger outside diameter than the solid shaft portion 338. The solid shaft portion 338 fits through the opening 330 in the wall 312*h* and extends in part out of opening 334. The sleeve portion of the outer shaft 314 has an exterior surface 314*a*.

The torsion spring 316 has an axially extending portion 316*a* at one end and a radially extending portion 316*b* at the other end. The axially extending portion 316*a* engages the slot 332, and the radially extending projection 316*b* engages the slot 340 when the hinge module 510 is assembled. The coils of the torsion spring 316 surround the shaft portion 338 of the outer shaft 314 and are received within the compartment 311. An arm 314*d* projects from the exterior end of first outer shaft 314 that is proximate the opening 312*b* and the arm 314*d* extends along a plane that is generally transverse to the central longitudinal axis of the first outer shaft 314.

The hinge module 310 includes a first pin 320 that is received at least in part in the bore of the sleeve portion 336. A compression spring 322 is housed within the bore of the sleeve portion 336 and biases the pin 320 outward from the sleeve portion 336 of the outer shaft 314. The disk 342 is provided with parallel slots that receive the prongs at the end of the shaft portion 338 that are defined by the slot 340. The disk 342 caps the opening 334.

The hinge module 410 includes an second outer housing 412 and a second outer shaft 414 disposed in substantial part in second outer housing 412. The second outer housing 412 and the second outer shaft 414 are rotationally coupled by a second torsion spring 416.

The second outer housing 412 is generally tubular and has a bore that is partitioned by a wall 412*h* into a torsion spring compartment 411 and a sleeve portion compartment 413. The compartment 413 has an interior 412*i* having an interior surface 412*a* and is accessible through an opening 412*b* opposite the wall 412*h*. The compartment 411 has an interior 412*j* having an interior surface 412*k* and is accessible through an opening 434 opposite the wall 412*h*. The wall 412*h* has a center hole 430 extending through the wall 412*h* and a slot 432 to one side of the center hole 430. An arm 412*d* projects from the exterior surface of the second outer housing 412 proximate the opening 412*b* and the arm 412*d* extends along a plane that is generally transverse to the central longitudinal axis of the second outer housing 412.

The outer shaft 414 has a tubular sleeve portion 436 with a hollow bore and a solid shaft portion 438 with a slot 440 at the end of the solid shaft portion that is farthest from the sleeve portion. The tubular sleeve portion 436 has a larger outside diameter than the solid shaft portion 438. The solid shaft portion 438 fits through the opening 430 in the wall 412*h* and extends in part out of opening 434. The sleeve portion of the outer shaft 414 has an exterior surface 414*a*.

The torsion spring 416 has an axially extending portion 416*a* at one end and a radially extending portion 416*b* at the other end. The axially extending portion 416*a* engages the slot 432, and the radially extending projection 416*b* engages the slot 440 when the hinge module 510 is assembled. The coils of the torsion spring 416 surround the shaft portion 438 of the outer shaft 414 and are received within the compartment 411. An arm 414*d* projects from the exterior end of second outer shaft 414 that is proximate the opening 412*b* and the arm 414*d* extends along a plane that is generally transverse to the central longitudinal axis of the second outer shaft 414.

The hinge module 410 includes a second pin 420 that is received at least in part in the bore of the sleeve portion 436. A compression spring 422 is housed within the bore of the sleeve portion 436 and biases the pin 420 outward from the sleeve portion 436 of the outer shaft 414. The disk 442 is provided with parallel slots that receive the prongs at the end of the shaft portion 438 that are defined by the slot 440. The disk 442 caps the opening 434.

The hinge modules 310 and 410 are placed end to end with the openings of the torsion spring compartments 311 and 411 facing each other and with a spacer bushing 511 between the disks 342 and 442. The spacer bushing 511 is hollow to allow clearance for the prongs at the ends of the shaft portions 338 and 438.

As an example of the application of the hinge module 510, the shafts 320 and 420 are pressed inward so that the hinge module 510 can be placed between openings in the base. The shafts 320, 420 move outward under spring bias to engage the holes in the base and secure the module 510 to the base. Prior to this step the arms 314*d*, 414*d* are moved rotationally relative to the arms 312*d*, 412*d* to preload the springs 316 and 416 when the arms 314*d*, 414*d* and the arms 312*d*, 412*d* are in relative positions corresponding to the open position of the lid. As the preloaded module 510 is secured to the base, the arms 314*d*, 414*d* are secured in receptacles provided for them in the base. The arms 312*d*, 412*d* are attached to the lid with the lid in the open position such that as the lid is moved to the closed position the springs 316 and 416 are more tightly wound up to store energy. This provides a hinge coupling between the lid and the base. Due to the preload of the springs 316, 416 the lid will be held in the open position with at least some force. The lid will then have to be moved to the closed position against the spring bias provided by the torsion springs 316, 416 thus storing energy in the torsion springs. The lid would be kept in the closed position by a separate latch (not shown). When the latch is opened then the lid automatically moves to the open position under the bias of torsion springs 316, 416, but in a controlled and smooth manner due to the damping effect of damping grease provided between the exterior surfaces of the sleeve portions of the outer shafts 314, 414 and the interior surfaces of the compartments 313, 413 of the outer housings 312, 412.

Referring to FIGS. 25-28, a damped hinge module 610 in accordance with a fifth preferred embodiment of the present invention can be seen. The hinge module 610 includes an outer housing 612 and an inner housing 614 disposed in substantial part in the outer housing 612. The outer housing 612 and the inner housing 614 are rotationally coupled by a torsion spring 616.

The outer housing 612 is generally tubular and has an interior having an interior surface 612*a* and is accessible through an opening 612*b* at one end of the outer housing 612. The end of the outer housing opposite the opening 612*b* is provided with a wall 612*h*. The wall 612*h* has a center hole 630 extending through the wall 612*h* and an eccentric hole 632 to one side of the center hole 630. The outer housing 612 is provided with a mounting plate 612*d* that is held at a position that is spaced apart from the generally cylindrical exterior surface 612*k* of the outer housing 612 by a plate-like support 612*j* having reinforcing ribs that extends from the exterior surface 612*k* of the outer housing 612. The mounting plate 612*d* has mounting holes that allow the outer housing 612 to be mounted to a structure such as, for example, a base or a lid of some device.

The inner housing 614 is generally tubular and is preferably sized to fit snugly within the outer housing 612. The inner housing 614 has an open end 614*c* to allow access to an interior 614*f* of the inner housing 614. A hole 614*b* is disposed within an end portion of the inner housing 614 that is opposite the open end 614*c* of the inner housing 614. The hole 614*b* is eccentric, i.e. the hole 614*b* is off center relative to the central longitudinal axis of the interior 614*f* of the inner housing 614. The inner housing 614 further includes an exterior surface 614*a*.

An end portion 636 of the inner housing 614 that is opposite the open end 614*c* is located outside the outer sleeve 612 and proximate the opening 612*b*. A hole 638 extends through the end portion 636 and is in communication with the interior 614*f* of the inner housing 614. The hole 638 is in registry with the hole 630.

The torsion spring 616 has a first axially extending portion 616*a* at one end and a second axially extending portion 616*b* at the other end. The axially extending portion 616*a* engages the hole 614*b* to couple one end of the torsion spring 616 to the inner housing 614, and the axially extending projection 616*b* engages the hole 632 to couple the other end of the torsion spring 616 to the outer sleeve 612 when the hinge module 610 is assembled. The coils of the torsion spring 616 are housed at least in part in the interior 614*f* of the inner housing 614 and, in the illustrated example, the coils are received within the interior of the outer housing 612. An eccentric projection 614*d* projects axially from the exterior end 636 of the inner housing 614. The projection 614*d* is positioned at a location that is spaced apart from the hole 638 and extends in a direction parallel to the central longitudinal axis of the inner housing 614.

The hinge module 610 includes a rod 620 that extends through the holes 638 and 630 and extends outward from the inner housing 614 and the outer housing 612 on either side of the hinge module 610. The hinge module 610 also includes a bracket 640 that includes a mounting portion 642 and arms 644 and 646 that are parallel to one another while being spaced apart from one another. The arms 644, 646 are connected at one end to the mounting portion 642. The end of each of the arms 644, 646 that is distal from the mounting portion 642 is provided with a sleeve 648, 650, respectively. Each of the arms 644, 646 has an arced portion and a straight portion. The straight portion of each arm 644, 646 extends from a respective sleeve 648, 650 to one end of the arced portion of the respective arm 644, 646. The arced portion of each arm 644, 646 extends from the straight portion of the respective arm 644, 646 to the mounting portion 642 of the bracket 640. The rod 620 extends through the sleeves 648, 650 at each of its external ends to pivotally support the bracket 640 relative to the inner housing 614 and the outer housing 612.

The bracket 640 and the inner housing 614 rotate together as a unit when the projection 614*d* is in contact with the arm 644 of the bracket 640 and the torsion spring 616 is under load. In the illustrated example, the torsion spring 616 is under load when it is wound up relative to its relaxed state. In the illustrated example, limited rotational movement of the bracket 640 relative to the inner housing 614 is possible when the torsion spring 616 is relaxed and the arm 644 is moving away from the projection 614*d* or toward the projection 614*d* until the arm 644 makes contact with the projection 614*d*.

The inner housing 614 is rotationally movable between a first position and a second position relative to the outer housing 612. When the module 610 is not installed in a device, the inner housing 614 can over rotate past the first position relative to the outer housing to an over rotation position where the torsion spring 616 is in a relaxed state. To move the inner housing 614 from the over rotation position to the first position in relation to the outer housing 612, the torsion spring 616 is wound up thus preloading the torsion spring 616. To move the inner housing 614 from the first position to the second position in relation to the outer housing 612, the torsion spring 616 is wound up even further increasing the force applied between the inner housing and the outer housing by the torsion spring 616. Therefore, the torsion spring 616 biases the inner housing 614 toward the first position when the inner housing 614 is between the first position and the second position, and the torsion spring 616 biases the inner housing 614 toward the over rotation position when the inner housing 614 is between the first position and the over rotation position. Grease is provided between the interior surface 612*a* of the outer housing 612 and the exterior surface 614*a* of the inner housing 614 for damping the rotational movement of the inner housing 614 relative to the outer housing 612.

The hinge module 610 further includes a seal 624, preferably in the form of an elastomeric O-ring 624, that is disposed within the groove 652 of the inner housing 614 in order to provide sealing engagement between the exterior surface 614*a* of the inner housing 614 and the interior surface 612*a* of the outer housing 612 when the hinge module 610 is assembled in order to aid in retaining the grease between the exterior surface 614*a* of the inner housing 614 and the interior surface 612*a* of the outer housing 612. It is also contemplated that the seal 624 provide a certain amount of rotational damping of the assembled hinge module 610.

As an example of the application of the hinge module 610, the hinge module 610 is mounted to the base or door frame of a device by placing fasteners (not shown) through the mounting holes in the mounting plate 612*d* to securely mount the outer housing 612, and consequently the module 610, to the base. Prior to this step the bracket 640 is moved rotationally relative to the outer housing 612 to preload the spring 616 and move the inner housing 614 from the over rotation position to the first position relative to the outer housing 612, which corresponds to the open position of the lid. The mounting portion of the bracket 640 is attached to the lid with the lid in the open position such that as the lid is moved to the closed position the spring 616 is more tightly wound up to store energy. This provides a hinge coupling between the lid and the base. Due to the preload of the spring 616 the lid will be held in the open position with at least some force. The lid will then have to be moved to the closed position against the spring bias provided by the torsion spring 616 thus storing energy in the torsion spring. The lid would be kept in the closed position by a separate latch (not shown). When the latch is opened then the lid automatically moves to the open position under the bias of torsion spring 616, but in a controlled and smooth manner due to the damping effect of the damping grease provided between the exterior surface of the inner housing 614 and the interior surface of the outer housing 612. The second position of the inner housing 614 relative to the outer housing 612 corresponds to the closed position of the lid.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention.

The invention claimed is:

1. A hinge module comprising:

a first member;

a second member rotationally movable relative to said first member between a first position and a second position, said second member being received at least in part within said first member; and a torsion spring located internally with respect to said first member and biasing said second member toward said first position relative to said first member, said spring having a preload with said second member in said first position relative to said first member, wherein said first member is an outer housing having an interior and an interior surface, said second member is an inner housing having an interior and an exterior surface, said inner housing is received at least in part within said interior of said outer housing with said exterior surface of said inner housing opposite at least a portion of said interior surface of said outer housing, and said torsion spring is received at least in part in said interior of said inner housing, and wherein said inner housing has an exterior end portion exterior to said outer housing, said exterior end portion of said inner housing has a hole, said outer housing has an end portion distal from said exterior end portion of said inner housing, said end portion of said outer housing has a hole in registry with said hole of said exterior end portion of said inner housing, the hinge module further comprising:

a pair of pins positioned to extend through said hole of said end portion of said outer housing and said hole of said exterior end portion of said inner housing, respectively; and a compression spring provided intermediate said pair of pins to bias each of said pair of pins outward from a respective one of said hole of said end portion of said outer housing and said hole of said exterior end portion of said inner housing.

2. The hinge module according to claim 1, wherein said second member is provided with a radially extending lever to provide an engagement surface for said second member.

3. A hinge module comprising:

a first member;

a second member rotationally movable relative to said first member between a first position and a second position, said second member being received at least in part within said first member; and a torsion spring located internally with respect to said first member and biasing said second member toward said first position relative to said first member, said spring having a preload with said second member in said first position relative to said first member, wherein said first member is an outer housing having an interior and an interior surface, said second member is an inner housing having an interior and an exterior surface, said inner housing is received at least in part within said interior of said outer housing with said exterior surface of said inner housing opposite at least a portion of said interior surface of said outer housing, and said torsion spring is received at least in part in said interior of said inner housing, and wherein said inner housing has an exterior end portion exterior to said outer housing, said exterior end portion of said inner housing has a hole, said outer housing has an end portion distal from said exterior end portion of said inner housing, said end portion of said outer has a hole in registry with said hole of said exterior end portion of said inner housing, the hinge module further comprising:

a bracket having first and second sleeves positioned to register with said hole of said end portion of said outer housing and said hole of said exterior end portion of said inner housing, respectively;

a rod passing through said first and second sleeves and said hole of said end portion of said outer housing and said hole of said exterior end portion of said inner housing to pivotally support said bracket relative to said outer housing; and an eccentrically located axial projection attached to said exterior end portion of said inner housing, said axial projection being capable of engaging said bracket to rotate said bracket with said inner housing.

4. The hinge module according to claim 3, wherein said second member is provided with a radially extending lever to provide an engagement surface for said second member.

5. A hinge module comprising:

a first member;

a second member rotationally movable relative to said first member between a first position and a second position, said second member being received at least in part within said first member; and a torsion spring located internally with respect to said first member and biasing said second member toward said first position relative to said first member, said spring having a preload with said second member in said first position relative to said first member, wherein said first member is an outer housing having an interior and an interior surface, said second member is an inner housing having an interior and an exterior surface, said inner housing is received at least in part within said interior of said outer housing with said exterior surface of said inner housing opposite at least a portion of said interior surface of said outer housing, and said torsion spring is received at least in part in said interior of said inner housing, wherein said outer housing has a circumferential groove and said inner housing has a radial projection positioned in said groove to thereby limit the amount of relative rotation between said inner housing and said outer housing, and wherein said outer housing has an axial groove communicating with said circumferential groove and said inner housing is capable of moving axially relative to said outer housing against axial bias provided by said torsion spring when said radial projection is aligned with said axial groove.

6. The hinge module according to claim 5, wherein said second member is provided with a radially extending lever to provide an engagement surface for said second member.

7. A hinge module comprising:

a first member;

a second member rotationally movable relative to said first member between a first position and a second position, said second member being received at least in part within said first member; and a torsion spring located internally with respect to said first member and biasing said second member toward said first position relative to said first member, said spring having a preload with said second member in said first position relative to said first member, wherein said first member is an outer housing having an interior and an interior surface, said second member is an inner housing having an interior and an exterior surface, said inner housing is received at least in part within said interior of said outer housing with said exterior surface of said inner housing opposite at least a portion of said interior surface of said outer housing, and said torsion spring is received at least in part in said interior of said inner housing, and wherein said outer housing has a pair of arc-shaped slots and said inner housing has a pair of snap legs that engage said pair of arc-shaped slots to limit the amount of relative rotation between said inner housing and said outer housing.

8. The hinge module according to claim 7, wherein said second member is provided with a radially extending lever to provide an engagement surface for said second member.

9. A hinge module comprising:

a first member at least defining an outer housing;

a second member having a shaft portion and a sleeve portion, said sleeve portion of said second member being tubular, said second member rotationally movable relative to said first member between a first position and a second position, said second member being received at least in part within said outer housing;

a torsion spring located internally with respect to said first member and biasing said second member toward said first position relative to said first member, said spring having a preload with said second member in said first position relative to said first member, said shaft portion of said second member extending at least in part within said outer housing, said torsion spring having coils that surround said shaft portion of said second member, said torsion spring having a radial projection that engages said shaft portion, and said torsion spring having an axial projection that engages said outer housing;

a compression spring received within said sleeve portion of said second member; and a pin that is received at least in part within said sleeve portion of said second member, said compression spring housed within said sleeve portion of said second member biasing said pin outward from said sleeve portion of said second member.

10. The hinge module according to claim 9, wherein said shaft portion has an end portion that has a slot that defines prongs in said end portion of said shaft, and said radial projection of said torsion spring extends into said slot in said end portion of said shaft.

11. The hinge module according to claim 10, wherein said outer housing is partitioned by a wall into a torsion spring compartment and a sleeve portion compartment, wherein said torsion spring compartment has an opening opposite said wall, the hinge module further comprising a disk that caps said opening of said torsion spring compartment, said disk having slots that receive said prongs in said end portion of said shaft.

12. The hinge module according to claim 11, wherein said second member is provided with a radially extending lever to provide an engagement surface for said second member.

13. The hinge module according to claim 10, wherein said second member is provided with a radially extending lever to provide an engagement surface for said second member.

14. A damped hinge module comprising:

two separate hinge modules according to claim 9, that are placed in end to end arrangement; and a spacer bushing extending from said disk of a first one of said two separate hinge modules to said disk of a second one of said two separate hinge modules.

15. The hinge module according to claim 14, wherein said second member is provided with a radially extending lever to provide an engagement surface for said second member.

16. The hinge module according to claim 9, wherein said second member is provided with a radially extending lever to provide an engagement surface for said second member.

* * * * *

UNITED STATES PATENT AND TRADEMARK OFFICE

CERTIFICATE OF CORRECTION

PATENT NO. : 8,104,142 B2
APPLICATION NO. : 12/281221
DATED : January 31, 2012
INVENTOR(S) : David Lowry, Eugene Novin and Mark Cooper It is certified that error appears in the above-identified patent and that said Letters Patent is hereby corrected as shown below:

Column 2, line 63, reads "another Suitable manner."
should read -- another suitable manner. --

Column 5, line 34, reads "Integral with one of the inner and outer housings 114, 112, a"
should read -- integral with one of the inner and outer housings 114, 112, a --

Column 9, line 33, reads "The hinge module 410 includes an second outer housing"
should read -- The hinge module 410 includes a second outer housing --

Column 10, line 66, reads "support 62j having reinforcing ribs that extends from the"
should read -- support 62j having reinforcing ribs that extend from the --

Signed and Sealed this
Twenty-third Day of October, 2012

David J. Kappos

David J. Kappos
*Director of the United States Patent and Trademark Office*